US005500979A

United States Patent [19]

Wörwag

[11] Patent Number: 5,500,979

[45] Date of Patent: Mar. 26, 1996

[54] VACUUM CLEANER

[75] Inventor: Peter Wörwag, Romanshorn, Switzerland

[73] Assignee: Firma Fedag, Romanshorn, Switzerland

[21] Appl. No.: 417,051

[22] Filed: Apr. 3, 1995

[30] Foreign Application Priority Data

Apr. 2, 1994 [DE] Germany ..... 44 11 526.1

[51] Int. Cl.[6] ..... A47L 5/32

[52] U.S. Cl. ..... 15/349; 15/351; 15/352; 15/335

[58] Field of Search ..... 15/349, 351, 352, 15/347, 348

[56] References Cited

U.S. PATENT DOCUMENTS

| | | | |
|---|---|---|---|
| 1,829,582 | 10/1931 | Carson . | |
| 3,460,188 | 8/1969 | Boyd | 15/349 X |
| 3,482,276 | 12/1969 | Fillery | 15/349 |
| 3,618,158 | 11/1971 | Worwag | 15/332 |
| 3,906,585 | 9/1975 | Mattsson | 15/349 |
| 4,490,882 | 1/1985 | Wells | 15/349 X |
| 5,018,240 | 5/1991 | Holman | 15/349 |
| 5,090,083 | 2/1992 | Wulff | 15/349 X |

FOREIGN PATENT DOCUMENTS 1928713 6/1969 Germany .

*Primary Examiner*—Chris K. Moore
*Attorney, Agent, or Firm*—Robert W. Becker & Associates

[57] ABSTRACT

A vacuum cleaner has a housing having a bottom portion with wheels. A handle rod with a handle for guiding and pushing the vacuum cleaner across a floor is connected to the housing. A suction blower with a drive motor is positioned in the housing. The housing comprises a brush roller chamber with a rotatably driven brush roller with brush elements positioned therein. The housing has a suction slot through which the brush elements of the brush roller extend. The housing further comprises a receiving chamber positioned between the brush roller chamber and the suction blower with a removable dirt collecting container received therein. The dirt collecting container has sidewalls wherein a first one of the sidewalls faces the brush roller chamber and has an inlet slot extending substantially over the length of the brush roller chamber for allowing passage of a suction air stream entering the suction slot into the dirt collecting container. A suction channel connects the brush roller chamber to the inlet slot for guiding the suction air stream from the brush roller chamber to the inlet slot. The suction channel tapers in a flow direction of the suction air stream and extends substantially over the length of the brush roller from a periphery of the brush roller upwardly to the inlet slot. The suction channel comprises a guide wall located adjacent to the bottom portion extending upwardly at a slant having a lower edge facing the brush roller chamber and delimiting the suction slot.

18 Claims, 17 Drawing Sheets

4
2
32
33
1
82
3
12
15
17
22
26
14
6
b
11
78'
34
21
9
28
24
27
8
7
80
16
80
5
78
66

VACUUM CLEANER

BACKGROUND OF THE INVENTION

The invention concerns a vacuum cleaner having a housing with a bottom portion and wheels for rolling the vacuum cleaner across the floor. A handle rod with a handle is provided for guiding and pushing the vacuum cleaner across the floor. The handle rod is connected to the housing. A suction blower with a drive motor is positioned in the housing. The housing comprises a brush roller chamber in which a rotatably driven brush roller with brush elements is positioned. The housing has a suction slot through which the brush elements of the brush roller extend. The housing further comprises a receiving chamber positioned between the brush roller chamber and the suction blower. A removable dirt collecting container is received in the receiving chamber. The dirt collecting container has sidewalls a first one of which faces the brush roller chamber. The first sidewall has an inlet slot extending substantially over the length of the brush roller chamber for allowing passage of a suction air stream entering the brush roller chamber through the suction slot into the dirt collecting container.

A vacuum cleaner of this kind, known from U.S. Pat. No. 1,829,582, has a dirt collecting container which can be inserted in a receiving chamber to retain coarse and fine particles of dirt. One sidewall has an inlet slot for a stream of suction air entering the brush chamber through the suction slot. The suction air stream carries the particles of dirt released by the brush roller into the dirt collecting container. The latter has a filter mat on the air outflow side through which the suction air stream flows and by which the particles of dirt are filtered out. Since the inlet slot is located in the dirt-collecting container above the brush roller, the suction air stream must lift the dirt particles correspondingly. The heavier dirt particles require a stronger suction air stream in order to perform the necessary lifting work. A stronger suction air stream, however, requires a correspondingly strong drive motor, which is very heavy and will impair the handiness of the vacuum cleaner.

It is an object of the present invention to develop a vacuum cleaner of the aforementioned kind in such a manner that, even with a moderate drive output, heavy dirt particles can be conveyed with certainty into the dirt collecting container and are retained safely in the dirt collecting container.

SUMMARY OF THE INVENTION

A vacuum cleaner according to the present invention is primarily characterized by:

a housing having a bottom portion with wheels for rolling the vacuum cleaner across a floor;

a handle rod with a handle for guiding and pushing the vacuum cleaner across a floor, the handle rod connected to the housing;

a suction blower with a drive motor positioned in the housing;

the housing comprising a brush roller chamber;

a rotatably driven brush roller with brush elements positioned in the brush roller chamber;

the housing having a suction slot through which the brush elements of the brush roller extend;

the housing further comprising a receiving chamber positioned between the brush roller chamber and the suction blower;

a removable dirt collecting container received in the receiving chamber;

the dirt collecting container having sidewalls wherein a first one of the sidewalls faces the brush roller chamber, wherein the first sidewall has an inlet slot extending substantially over the length of the brush roller chamber for allowing passage of a suction air stream entering the brush roller chamber through the suction slot into the dirt collecting container;

a suction channel connecting the brush roller chamber to the inlet slot for guiding the suction air stream from the brush roller chamber to the inlet slot, the suction channel tapering in a flow direction of the suction air stream;

the suction channel extending substantially over the length of the brush roller from a periphery of the brush roller upwardly to the inlet slot;

the suction channel comprising a guide wall located adjacent to the bottom portion and extending upwardly at a slant, the guide wall having a lower edge facing the brush roller chamber and delimiting the suction slot.

Preferably, the suction channel and the dirt collecting chamber form a unitary part.

The suction channel has a free end facing the brush roller chamber, the free end partially enclosing the periphery of the brush roller.

Expediently, the free end partially encloses the periphery of the brush roller about an angle at circumference of 90° to 180°.

The suction channel has an exterior surface with a wraparound receiving element for receiving a seal for air-tightly sealing off the receiving chamber.

The dirt collecting container is positioned in the receiving chamber such that the sidewalls of the dirt collecting container are spaced from walls of the receiving chamber, wherein at least one of the sidewalls is provided with holes.

The bottom portion comprises a receiving dome, positioned between the brush roller chamber and the receiving chamber, for receiving at least one caster.

The caster is a guide coaster that swivels about a vertical axis.

Preferably, the vacuum cleaner comprises a plurality of the casters and further comprises a shaft for connecting the casters, wherein the shaft is positioned perpendicular to a direction of travel of the vacuum cleaner and is eccentrically supported within the housing. The casters are preferably height-adjustable with the shaft.

Advantageously, the brush roller projects with one axial end laterally past the receiving chamber.

The bottom portion expediently comprises outlet openings facing the floor for exhausting the suction air stream.

The handle rod is connected to a rearward portion of the housing so as to be pivotable from a substantially upright position about 90°, wherein the pivot axis of the handle rod is the axis of rotation of the drive motor.

The handle rod is arrestable in a working position in which the handle rod is pivoted by 45° relative to the upright position.

The axis of rotation of the drive motor, when viewed in a direction of forward travel of the vacuum cleaner, is advantageously positioned before of a rotational axis of the wheels.

The vacuum cleaner in a preferred embodiment further comprises a fine dirt box with a fine dirt receptacle connected to the handle rod. The fine dirt box is arranged downstream of the dirt collecting container in the flow direction of the suction air stream.

The suction air stream is preferably guided through the handle rod.

According to another embodiment of the present invention, the vacuum cleaner further comprises a first hose for connecting an end of the handle rod facing the fine dirt box to the receiving chamber and a second hose for connecting an end of the handle rod facing away from the fine dirt box to the fine dirt receptacle.

The fine dirt box advantageously comprises a dust filter arranged downstream of the fine dirt receptacle, wherein the dirt filter has a filter surface area of preferably substantially 1 $m^3$.

The suction channel tapering in its height and extending over the width of the brush roller accelerates the suction air stream in the direction of the inlet slot, as a result of which there is a safe transfer of particles of dirt into the dirt collecting container once they have been trapped. Heavier particles of dirt trapped in the zone of the brush roller are accelerated tangentially to the periphery of the rotating brush roller and hit against the guide wall of the suction channel, along which they are guided, because of its slanted position, into the zone of accelerated flow. The accelerated flow is sufficient to carry along heavy dirt particles, lying on the guide wall leading obliquely upwardly to the inlet slot, into the inlet slot. The guide wall is thus used as a chute for heavy particles of dirt. This design ensures that even heavy dirt particles are picked up despite a low and moderate drive output of the suction blower. The handiness of the vacuum cleaner is increased because of the resulting low weight.

The suction channel forms a one-part component with the dirt collecting container, so that, once the dust collection container is taken out of the receiving chamber, the brush roller lies exposed and can thus be serviced.

In the outer mantle surface of the suction channel, a wraparound receiving element is advantageously constructed for receiving a seal for airtightly sealing the receiving chamber. Streams of air leaking into the receiving chamber which could lead to turbulence and performance losses are thus prevented.

In a further development of the invention, the dirt collecting container is located with an essential all-round distance in the receiving chamber, holes being provided in the walls of the dust-collecting container. Because of this, a substantially uniform vacuum prevails in the entire intermediate space between dirt collecting container and receiving chamber, so that the suction air stream entering the dirt collecting container passes uniformly through all the holes located in the sidewall of the dirt collecting container. As the holes are located at least over the largest part of the dirt collecting container, it is ensured that no preferred direction of flow arises from the suction side to the outlet side which would favor clogging of the outlet side.

In order to achieve a good handiness and mobility, it is provided that, seen in the direction of operation, behind the brush roller chamber in the bottom portion, receiving domes for casters are located. These casters preferably can be pivoted about a vertical axis. These casters are provided in addition to wheels located to the rear of the bottom portion and provide height-adjustability between the underside of the bottom portion and the floor. Therefore, in the zone of the suction slot, the entry of the suction air can be influenced in order to make possible an optimal pick-up of dirt particles.

The vacuum cleaner has a pivotable handle rod, the pivot axis of which may coincide with the axis of rotation of the drive motor. The handle rod can be pivoted between a vertical position (upright position) and a horizontal position, which can be used, for example, for accessing the space under pieces of furniture that are low to the ground. For an ergonomically favorable handling of the vacuum cleaner, the handle column can be locked in a working position of about 45°.

In order to prevent with certainty the vacuum cleaner from tipping up, both when in its rest position as well as in its working position, it is provided that the axis of rotation of the drive motor in a travel direction of the vacuum cleaner is in front of the rotational axis of the rear wheels which support the main weight of the vacuum cleaner. In this manner, the person using the vacuum cleaner is completely relieved of the weight of the vacuum cleaner.

On the handle rod, a fine dirt box with a fine dirt receptacle, located downstream of the dirt collecting container, can be arranged. The suction air stream coming out of the receiving chamber is subjected in this case to an additional cleaning step for filtering out fine particles of dirt. For this purpose, the suction air stream can be led through the internal space of the handle rod, the handle rod being removably pushed into a hose for connecting it to the receiving chamber. If the handle rod is separated from the hose, dirt can be sucked from upholstery and from corners with the free end of the handle rod functioning as a suction nozzle. The other end of the handle column expediently opens into a hose which is connected to the fine dirt receptacle.

A dust filter with a filter area of preferably about 1 $m^2$ can be located on the downstream side of the fine dust receptacle. This dust filter filters out very fine dust and bacteria from the suction air stream, so that the vacuum cleaner can also be used in clean rooms.

BRIEF DESCRIPTION OF THE DRAWINGS

Other features of the invention emerge from the description and drawings, in which practical examples of the invention described individually below are illustrated. It is shown in.

DESCRIPTION OF PREFERRED EMBODIMENTS

Figure 1:
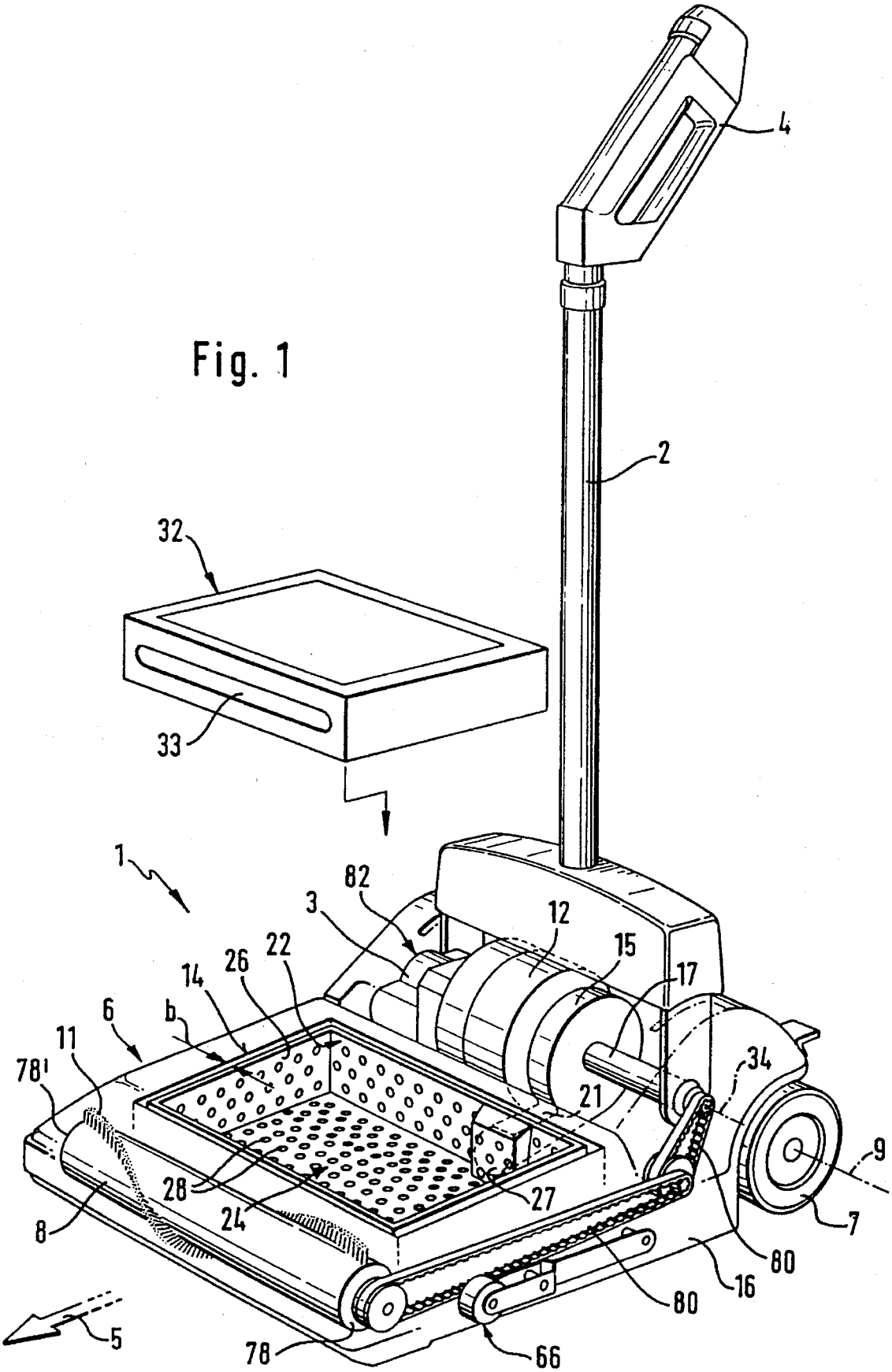
FIG. 1 a perspective view of the inventive vacuum cleaner according to the invention, with a cutaway portion showing the receiving chamber.
Figure 2:
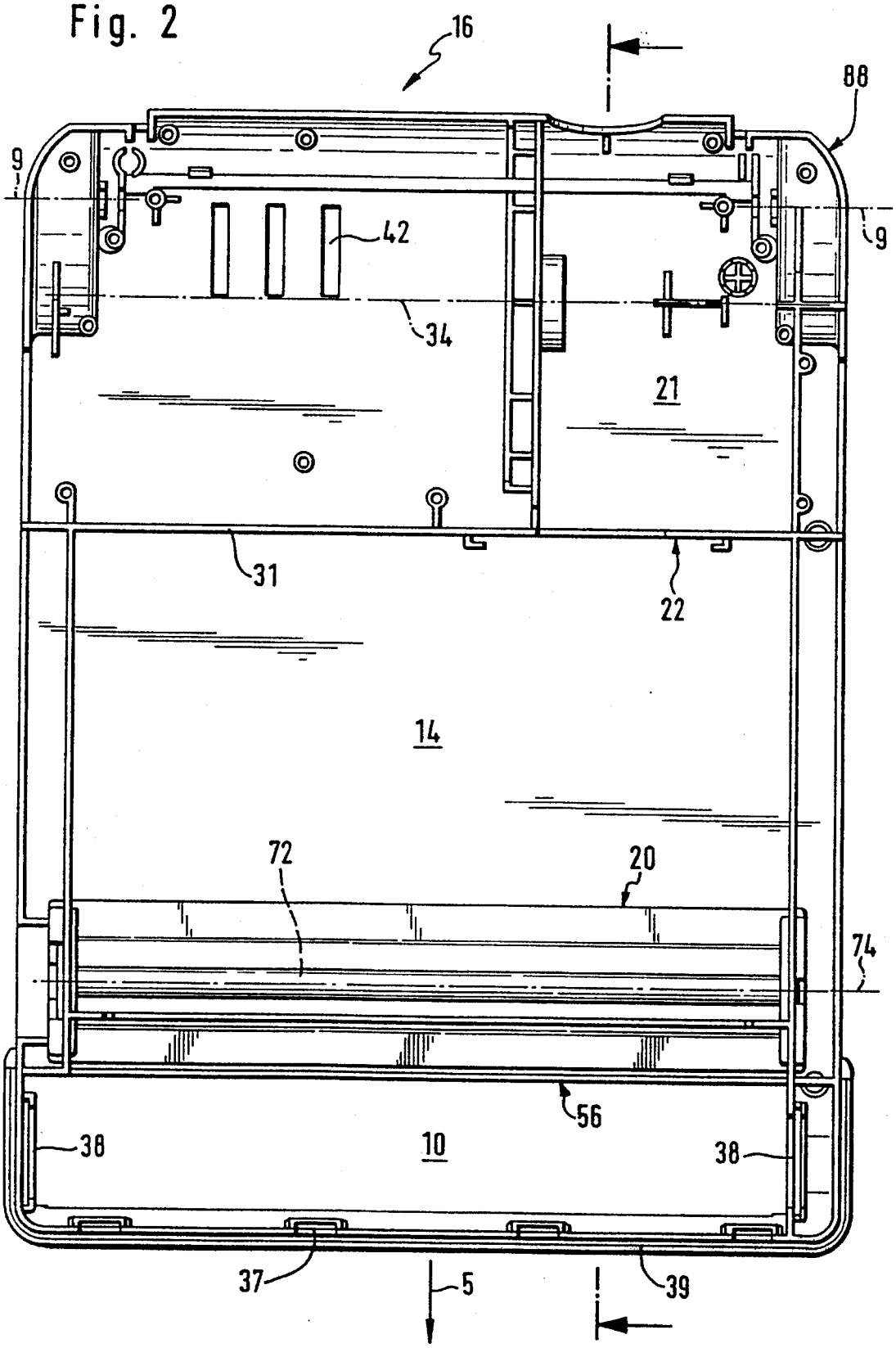
FIG. 2 a bottom view of the housing with receiving chamber.
Figure 3:
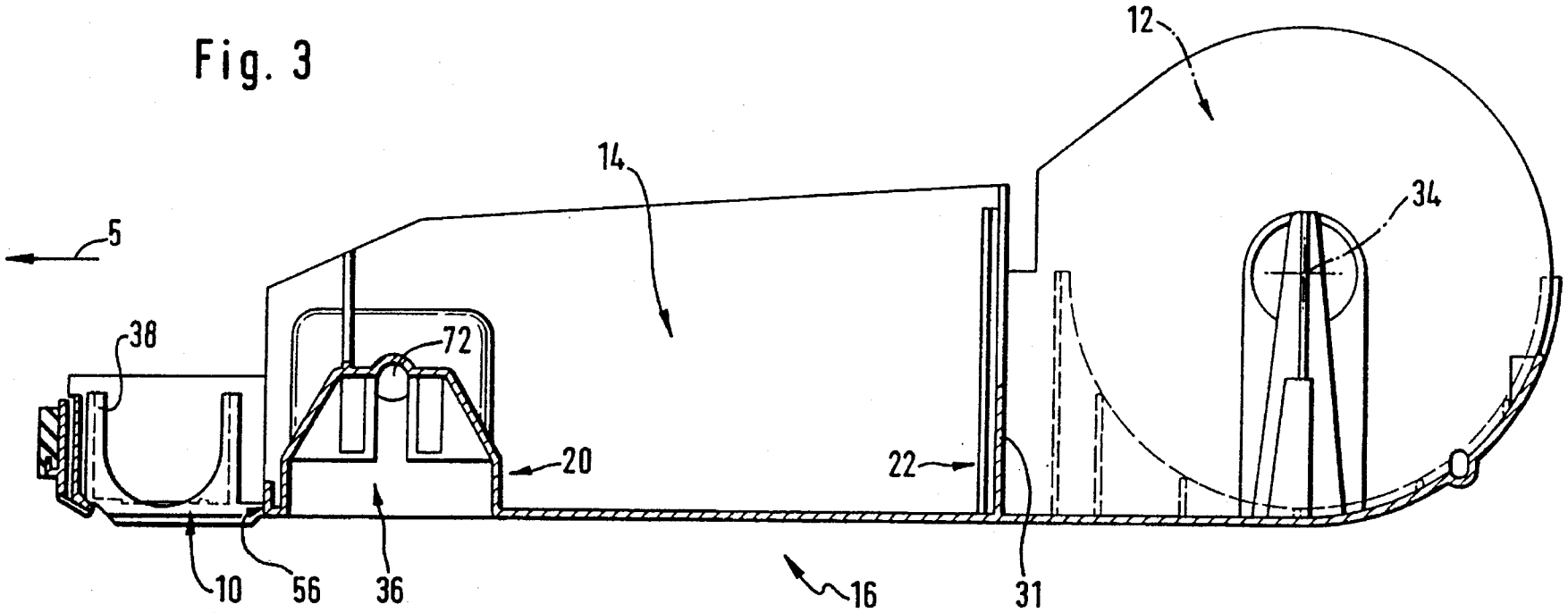
FIG. 3 shows a sectional view of the bottom portion.

The vacuum cleaner 1 illustrated in a perspective view in FIG. 1 consists basically of a housing 6 which has a bottom shell 16 as a carrying component. The bottom portion 16 has, in its central zone, a receiving chamber 14 open at the top (FIGS. 2 and 3). In the front zone of the bottom portion 16, seen in the travel direction 5, a suction slot 10 opening downwardly is provided, across which a cylindrical brush roller 8 extends. The brush roller 8 is connected to a drive unit 82 with drive belts 80 and driven in rotation. A brush 11 is located on the mantle surface of the brush roller 8, which extends to the floor through the suction slot 10 and, because of the rotation of the brush roller 8, picks up coarse and fine dirt particles from the floor being cleaned. A suction air stream produced by a suction blower 12 which is operated by a drive motor 3 carries the dirt particles picked up from the floor and sucks them into the bottom portion 16 toward a receiving chamber 14, from where the suction air stream is led out through an exhaust channel 21 in order to be subjected to further filtering or to be exhausted into the atmosphere.

Figure 6:
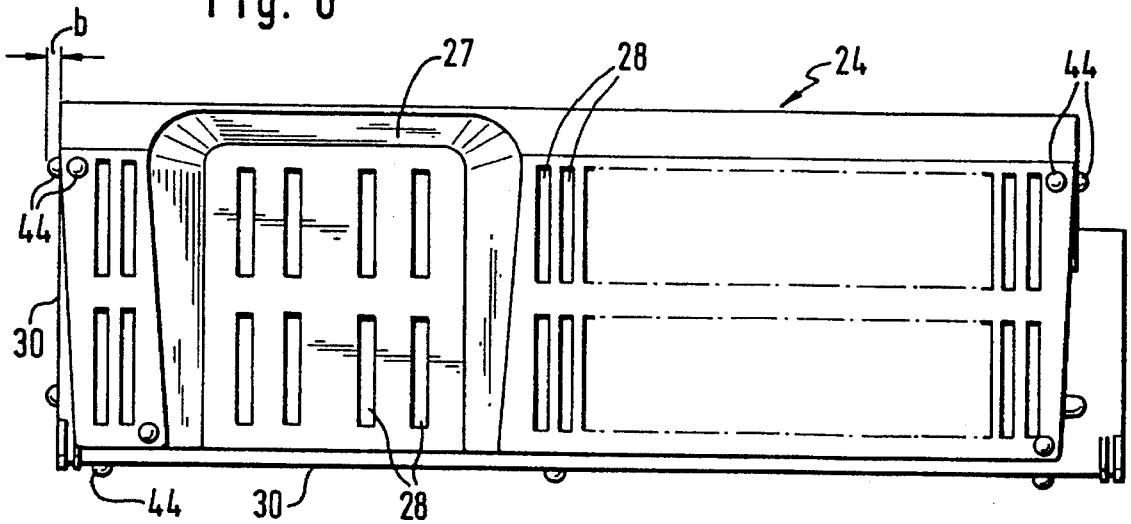
FIG. 6 shows a rear view of the dirt collecting container.
Figure 7:
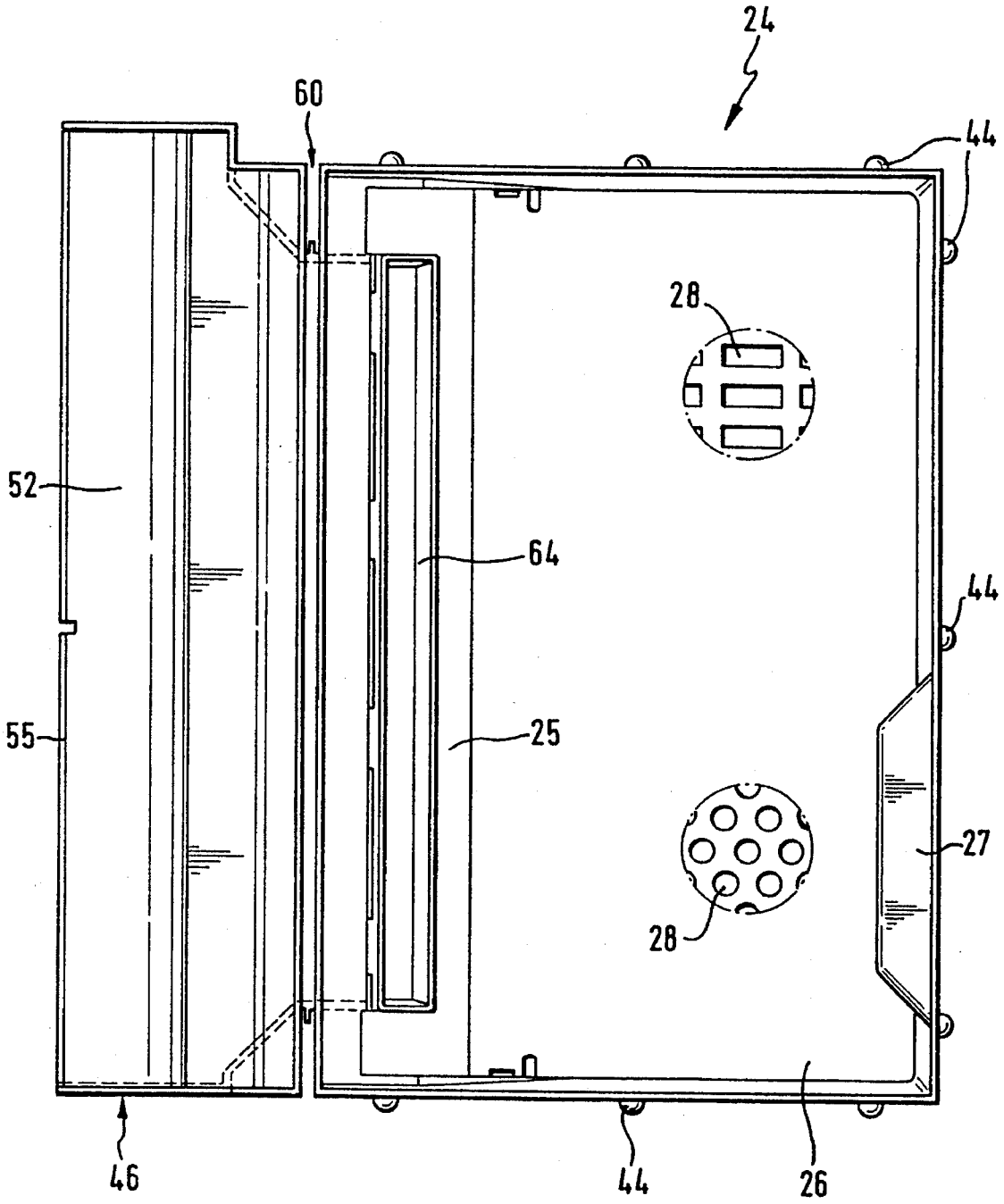
FIG. 7 shows a top view of the dirt collecting container.

In the receiving chamber 14, in accordance with the invention, a dirt collecting container 24 is inserted which is preferably made of plastic and has approximately 4 liter holding capacity. The sidewalls 26 are provided with holes or cutouts 28 which, according to FIG. 1, have a circular shape in cross-section, but can in principle have any shape whatsoever, such as, for example, a rectangular shape, and may be distributed regularly or randomly over the sidewalls 26, see FIG. 7. On the external sides of the dirt collecting container 24 spacers 44 are provided (FIG. 6), so that the external sides 30 of the dirt collecting container 24 are at a distance from the receiving chamber 24. The spacers 44 can have the shape of knobs or, according to a practical example not illustrated here, can be constructed as molded beveled walls located at an angle to the wall of the receiving chamber of the dirt collecting container. By this, according to FIG. 6, an intermediate space between the holder compartment 14 and the dirt collecting container 24 is defined, the width b of which is determined by the height of the knobs. This intermediate space situated between the suction side 20 facing the suction slot 10 and the discharge side 22 of the holder compartment 14 facing the suction blower 12 is subject to a vacuum because of the suction air flowing through it, so that the suction air which has entered the dirt collecting container 24 passes through the perforations (holes) of the dirt collecting container and is led out of the holder compartment 14 via the discharge side 22. The dirt collecting container 24 has a concave section 27 on the discharge side 22 in the zone of the opening of the exhaust channel 21, by which there is provided a slightly larger distance between external wall of the dirt collecting container 24 and the mouth of the exhaust channel than in the remaining zone of the intermediate space. This favors the propagation of the vacuum in the entire intermediate space. No preferred direction of flow from the suction side 20 directly to the exhaust air side 22 arises, since a more or less uniform vacuum prevails everywhere in the intermediate space between the dirt collecting container 24 and the receiving chamber 14, so that the suction air can flow more or less uniformly through all the holes in the sidewalls of the dirt collecting container 24. It is thus ensured that the suction air does not flow in preference either through the exhaust air side or any other sidewall of the dirt collecting container, which would favor clogging of the perforations by coarse and conglomerate dirt particles. Because of the uniform exit of the stream of suction air through all the holes provided in the sidewalls of the dirt collecting container 24, a deposition of dirt on only one sidewall is reliably prevented, so that uniform filling of the dirt collecting container with dirt particles of different sizes is ensured.

It may be expedient to construct one sidewall of the dirt collecting container 24, especially the front limiting sidewall 25, located at the suction side 20, so as to be closed—without perforations—and to have this sidewall rest directly on the bottom portion 16, so that at this point no intermediate space is formed between the dirt collecting container 24 and the receiving chamber 14. Because of this, a pressure drop occurs in the intermediate space, while the vacuum increases in the direction of the exhaust air channel 21. This favors an accelerated and directed extraction of the suction air stream from the intermediate space.

Figure 8:
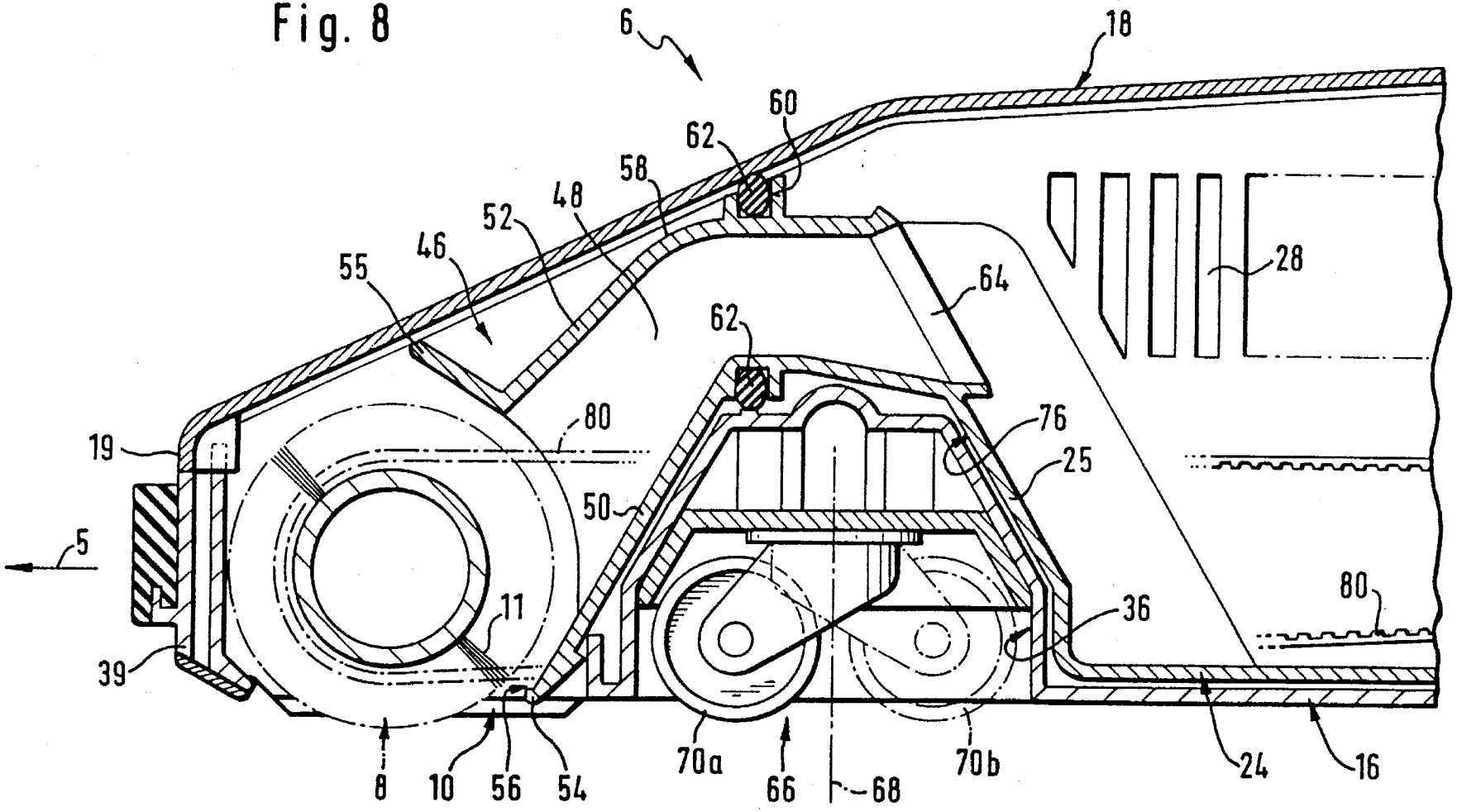
FIG. 8 shows a side view of the housing with inserted dirt collecting container, brush roller, and casters.

As shown in FIG. 1, a filter 32 can be inserted into the dirt collecting container 24 which filters fine dirt particles out of the suction air stream. The filter 32 has on its front side facing the brush roller 8 a slot 33 through which the suction air stream enters the filter, and which advantageously has the same cross-section as an inlet slot 64 of the dirt collecting container 24 on the suction side 20, see FIGS. 4 and 8. The inlet slot 64 extends expediently over the entire length of the brush roller 8 and forms the mouth of a suction channel 48 extending between brush roller 8 and receiving chamber 14, which is formed by an air guide 46. In a preferred embodiment, the air guide 46 is joined in one piece with the dirt collecting container 24. A lower guide wall 50 and a top guide wall 52 (FIG. 4) delimit the suction channel 48, which tapers toward the receiving chamber 14 from the zone of the air guide 46 facing the brush roller 8 and ensures a defined inflow direction of the suction air stream from the floor toward the receiving chamber. The forward, free end 53 of the air guide 46 facing the brush roller 8 can expediently partially enclose the brush roller 8, FIG. 4. The lower guide wall 50 and the top guide wall 52 of the air guide 46 enclose the brush roller 8 preferably over an angle at circumference of approximately 90°. The free end 55 of the top guide wall 52 may, according to FIG. 4, lie concentric with the mantle surface of the brush roller 8, or, as illustrated in FIG. 8, be constructed in a different embodiment as a straight end piece which is aligned approximately tangentially to the mantle surface of the brush roller 8.

The free ends of the air guide 46 enclose the brush roller 8 preferably over its entire length, so that even the dirt particles picked up from the floor at the axial end faces of the brush roller 8 are conveyed with certainty through the suction channel 48 to the dirt collecting container 24 and turbulence in the suction air stream and deposits of dirt caused by turbulence in corners, edges, and niches are avoided with certainty.

A bottom lip 54 is formed by the free end of the lower guide wall 50 of the air guide 46. This lip ends closely above the floor and is delimited by the rear side of the suction slot 10 when viewed in the travel direction 5. The front end of the suction slot 10 is formed by a front wall 39 of the bottom portion 16, FIG. 2. It has proved expedient to construct a greater air gap between the front wall 39 of the bottom portion 16 and the floor than between the bottom lip 54 and the floor. This ensures that even large dirt particles, such as, for example, cigarette stubs, can reach the area of the suction slot 10 without being pushed away by the front wall 39. At the rearward delimiting wall of the suction slot 10, formed by the bottom lip 54, dirt particles of are prevented from slipping past the suction slot 10 under the vacuum cleaner by the bottom lip 54 which reaches deeper down. The dirt particles are lifted by the slanted orientation of the lower guide wall 50 of the air guide 46 into the suction channel 48.

Because of the single-piece construction of the air guide 46 and the dirt collecting container 24, the top zone of the brush roller 8 is exposed when taking the dirt collecting container out of the receiving chamber 14. The brush roller 8 can then, for example, be freed of dirt adhering to the brush elements 11. In another embodiment, not illustrated here, the dirt collecting container 24 and the air guide 46 can be constructed in two parts, so that for emptying the vacuum cleaner, only the dirt collecting container 24 can be removed from the receiving chamber 14, without the air guide 46 also having to be removed. It may also be expedient to join only the top guide wall 52 of the air guide 46 detachably to the dirt collecting container 24 in order to create a top access to the brush roller 8 independently from the dirt collecting container 24.

Figure 9:
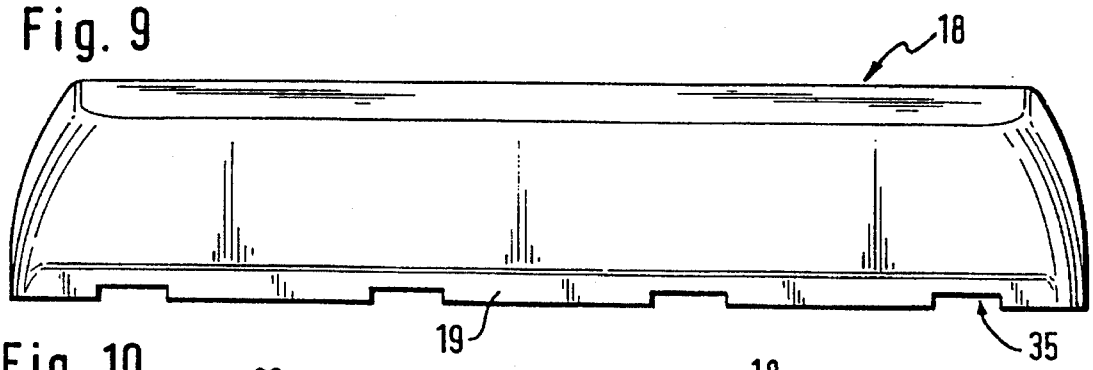
FIG. 9 shows a front view of the cover.
Figure 10:
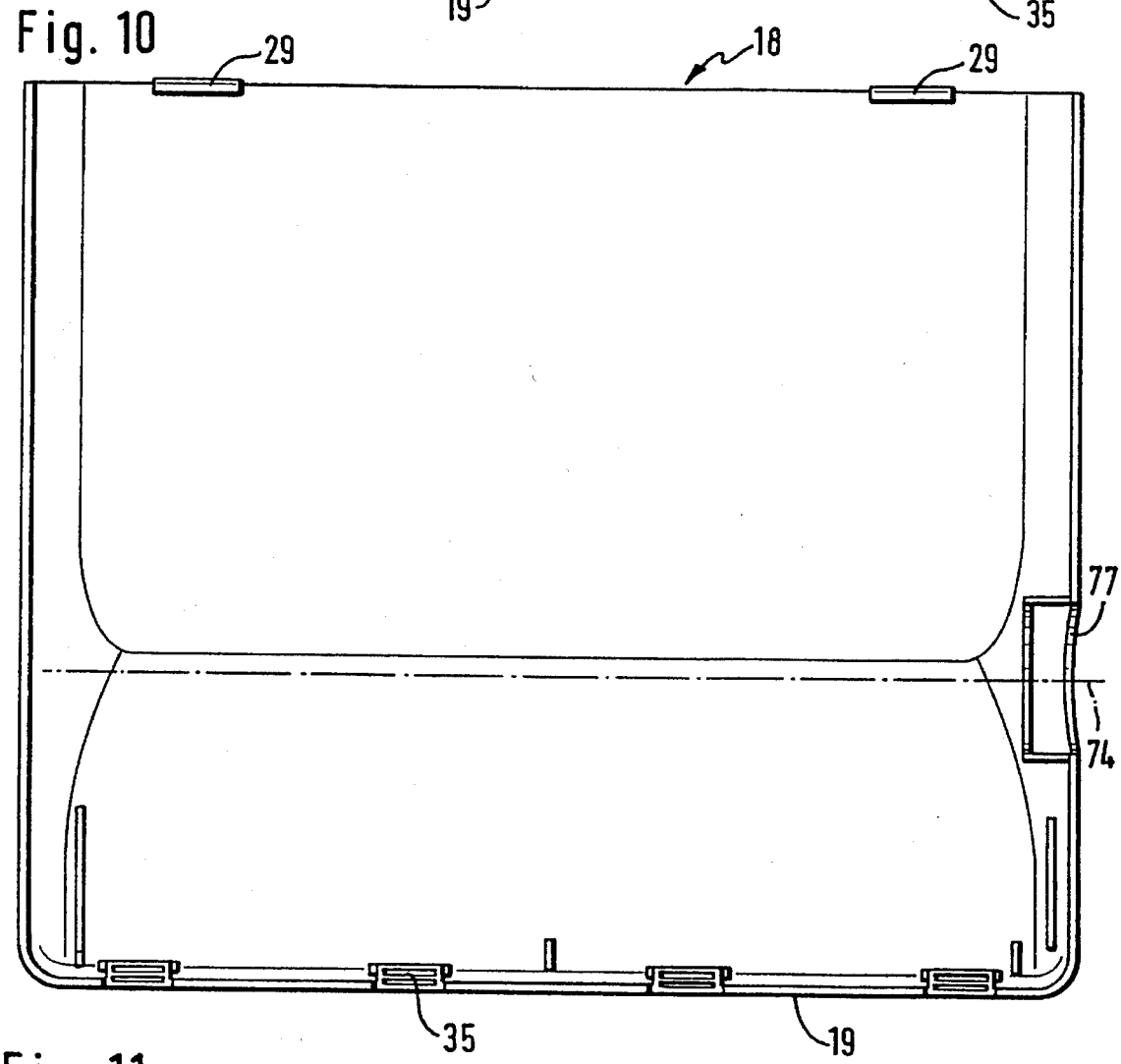
FIG. 10 shows a top view of the cover.
Figure 11:
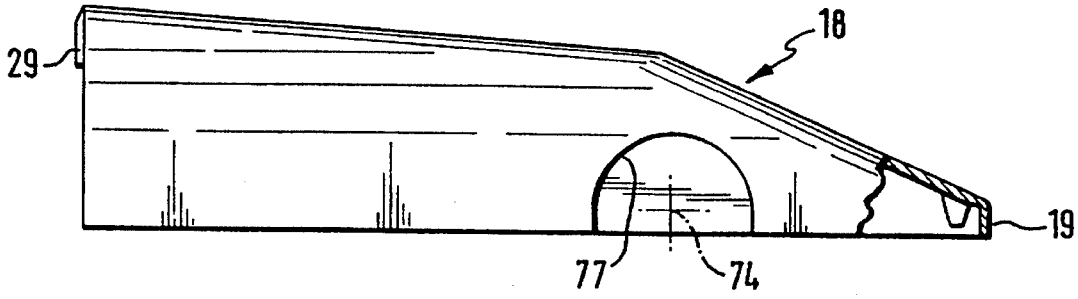
FIG. 11 shows a side view of the cover.
Figure 12:
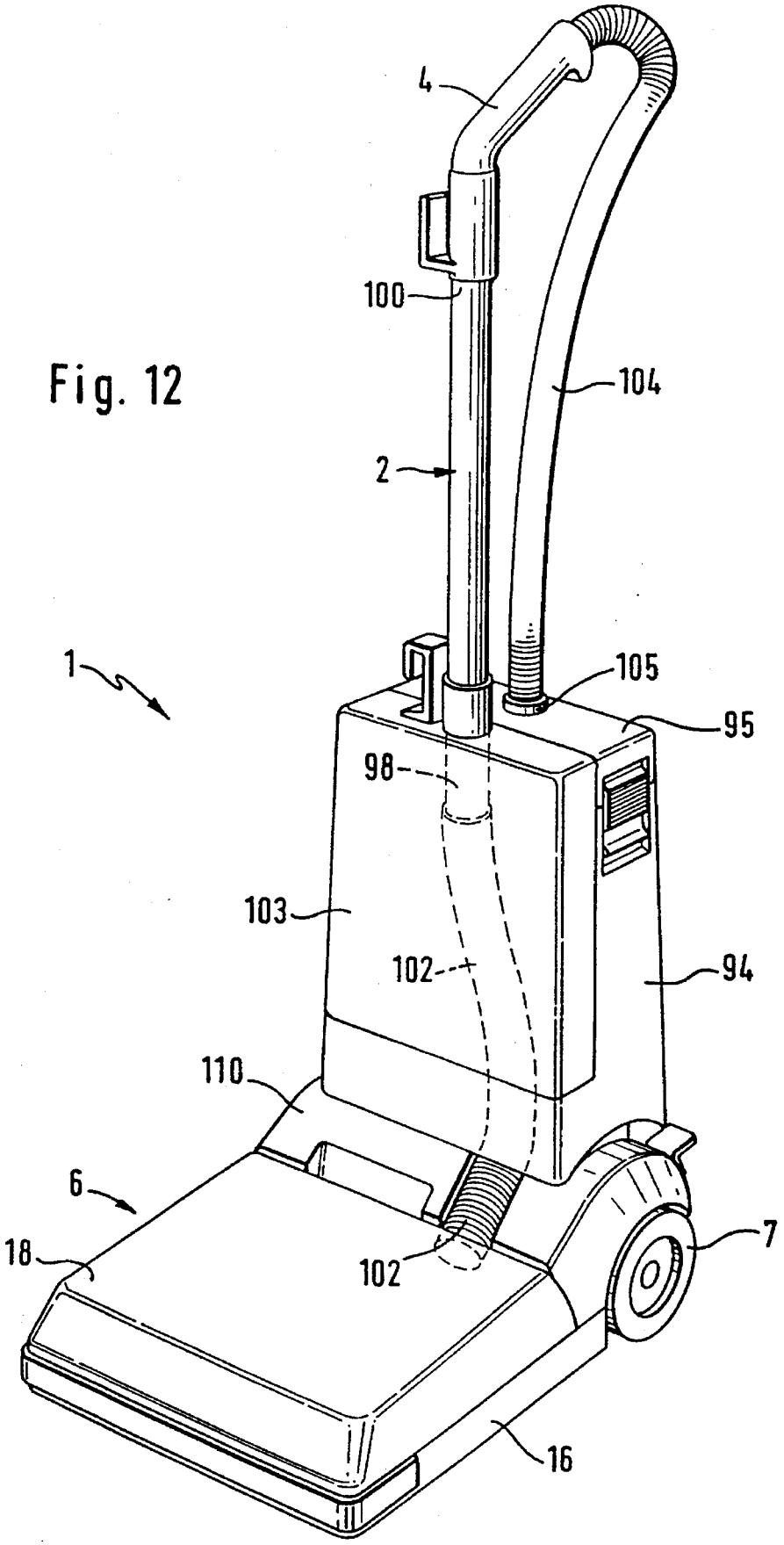
FIG. 12 shows a perspective view of the inventive vacuum cleaner in an embodiment with fine dust box.

A cover 18 is placed onto the bottom portion 16 which covers the brush roller 8 and the receiving chamber 14. According to FIGS. 9, 10, and 11, the cover 18 consists of a top, side limiting walls and a front side 19, which partially covers the front end of the brush roller 8. According to FIG. 10, the cover 18 has latch extensions 29 which can be locked into recesses (not illustrated) on the top edge of the limiting wall 31 of the receiving chamber 14 situated on the exhaust air side 22. On the front side 19, latch recesses 35 are provided likewise, into which the latch extensions 37 of the front wall 39 of the bottom portion 16 engage, see FIG. 2. In the case of the air guide 46 and dirt collecting container 24 being made in two pieces, it may be advantageous to construct the cover 18 also in two pieces, so that the dirt collecting container 24 or the air guide 46 can be taken out individually.

Figure 4:
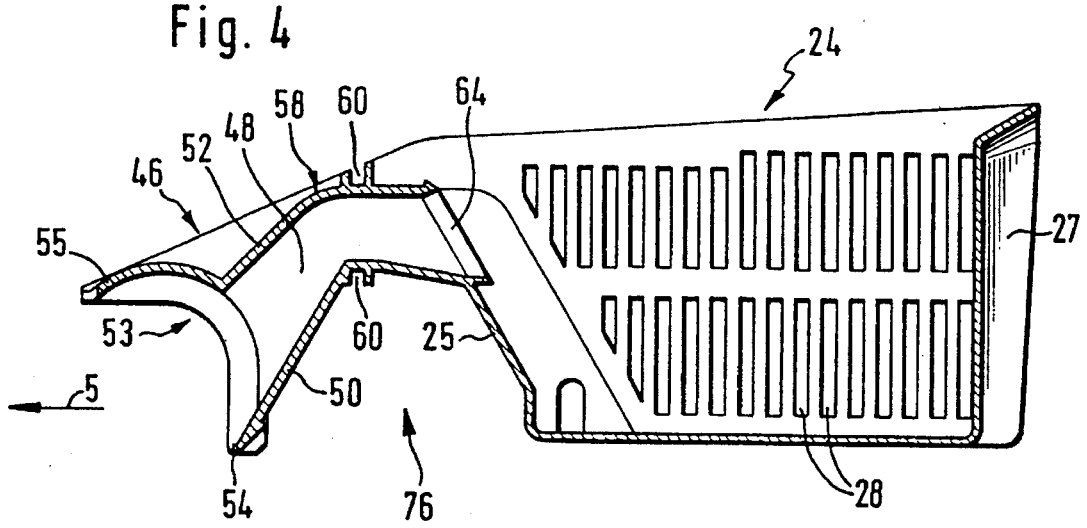
FIG. 4 shows a section through the dirt collecting container.
Figure 5:
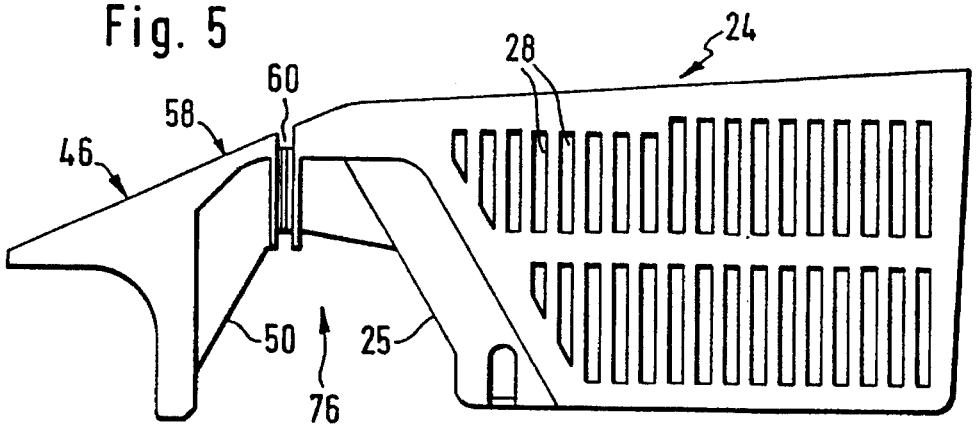
FIG. 5 shows a side view of the dirt collecting container.

On the external mantle surface 58 of the air guide 46, a wraparound receiving element in the form of a groove 60 is preferably provided, FIGS. 4 and 5, into which a seal 62 can be inserted, FIG. 8. The seal 62 seals the receiving chamber 14 airtightly in relation to the bottom portion 16 as well as to the side limiting walls and the top of the cover 18, in order to prevent air stream leaks between the air guide and the atmosphere, which could lead to turbulence of the suction air stream and reductions in performance.

As can be taken from FIG. 8, in the bottom portion 16 a more or less trapezoidal recess 76 is advantageously molded between brush roller 8 and receiving chamber 14, in which casters 66 are located, especially guide casters 70 which can be pivoted about a vertical axis 68 to thereby ensure great mobility of the vacuum cleaner 1. The guide casters 70 can be pivoted about their vertical axis 68 without obstruction because of the trapezoidal recess 76 which broadens downwardly, see positions **70*a* and 70*b* in FIG. 8. In order to be able to fit the dirt collecting container 24 and the air guide 46 positively into the bottom portion 16, the recess 76, in accordance with FIGS. 4 and 5, is also formed by the bottom guide wall 50 of the air guide 46, or a front limit sidewall 25 of the dirt collecting container 24. The guide coasters 66 are fixed so as to be height-adjustable on an eccentrically supported shaft 72, the shaft axis 74 of which extends transversely to the travel direction 5 through the trapezoidal recess (receiving dome) 76, see FIG. 2. The height adjustment of the guide casters 66 can be carried out from outside with the cover 18 closed, for which a more or less semicircular recess 77 is provided on a side limit wall of the cover 18, see FIG. 11. It is expedient to provide several locking positions for the height adjustment of the casters, in order to make possible an easy transition from one locking position to another. Due to the height-adjustability of the caster, the distance between the underside of the brush roller 8 or of the suction slot 10** to the floor to be cleaned can be selected; this distance can be matched to the particular floor condition or the kind of dirt to be picked up (coarse dirt, fine dirt).

Figure 13:
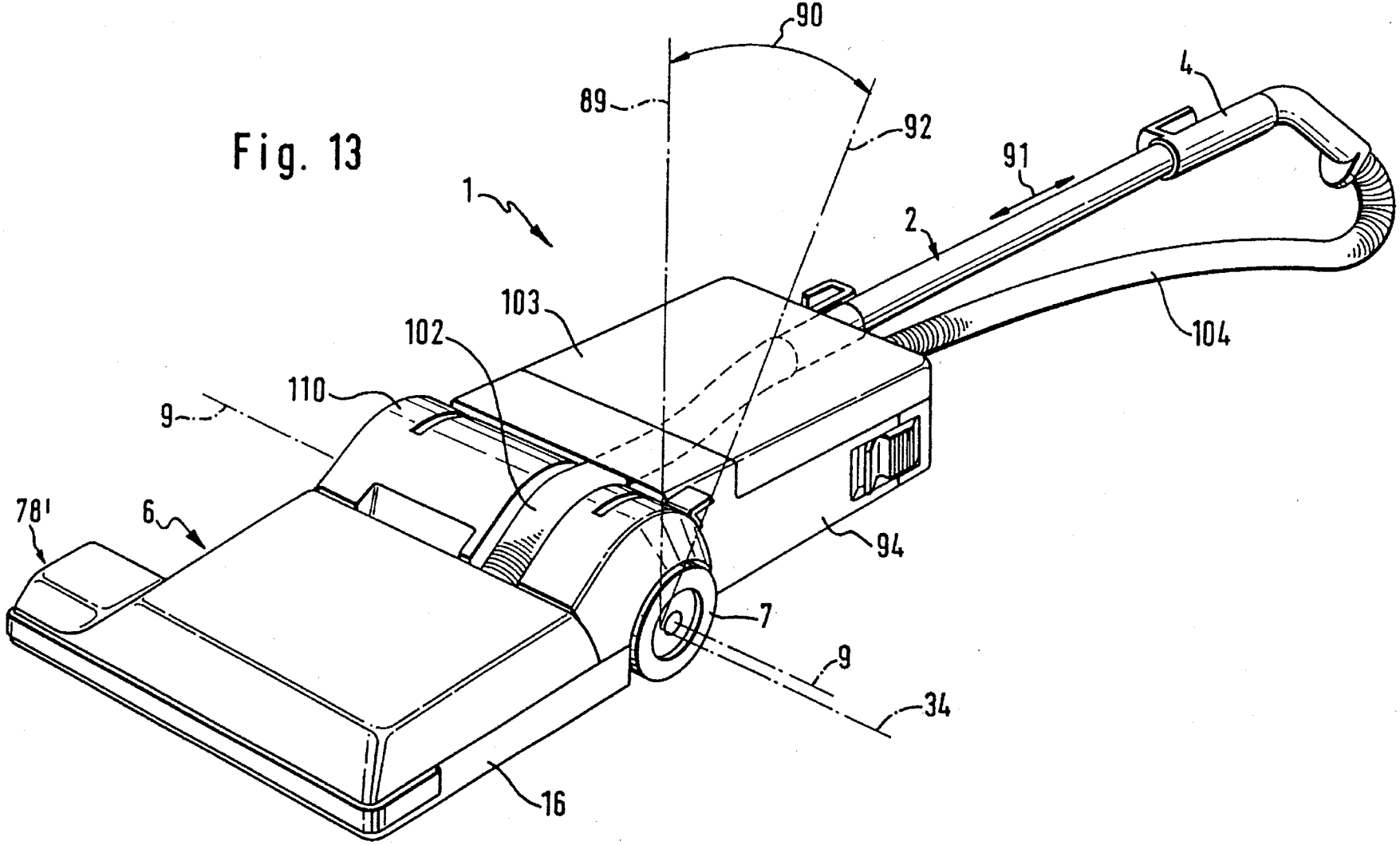
FIG. 13 shows a perspective view of the inventive vacuum cleaner of FIG. 12 in the stretched out position.

In order to provide for a maximum width of suction, the brush roller 8 extends expediently over the entire width of the housing 6 or of the dirt collecting container 24. In order to increase the suction width, the brush roller 8 can also have a greater length than the width of the dirt collecting container 24 and protrude with one of end face 78 or 78' at least on one side beyond the dirt collecting container 24, see FIGS. 13 and 14. In this case, to enclose the brush roller 8 and to construct the suction slot 10, the bottom portion 16 itself, the air guide 46, and also the cover 18 are matched to the protruding length of the brush roller 8.

The brush roller 8 is driven with drive belts 80 by a drive unit 82. The drive unit 82 according to FIG. 1 can be a turbine 15, which is driven by the suction air stream coming out of the receiving chamber 14. The turbine 15 fixedly connected to a shaft 17. About the free end of the shaft 17 the drive belt 80 is guided. The rotational axis of turbine 15 and shaft 17 is preferably identical to the axis of rotation 34 of the drive motor 3. According to FIG. 14, the drive unit 82 can also be a separate electric drive motor 86 which is provided in addition to the drive motor 3 of the suction fan 12. It is also possible to use the drive motor 3 as a drive unit, the high rotation speed of the drive motor being reduced to the rotation speed of the brush roller by gear reduction.

After flowing through the dirt collecting container 24 the suction air stream leaves the receiving chamber 14 through an exhaust air channel 21 located on the exhaust air side 22 of the receiving chamber 14 and is led to the suction fan 12. In the embodiment according to FIG. 1 the suction air stream is finish-filtered and leaves downstream of the suction blower 12 the vacuum cleaner through outlet openings 42 which are located in the bottom portion 16 (FIG. 2) and may have a rectangular cross-sectional shape. The air stream is accordingly directed to leave the vacuum cleaner toward the floor and into the carpet. This has a noise-damping effect.

In the rear zone 88 of the bottom section 6 a pivotable handle rod 2 with a handle 4 is located, which is used to push and guide the vacuum cleaner. In a preferred embodiment, the pivot axis of the handle rod 2 coincides with the axis of rotation 34 of the drive motor 3. The handle rod 2 can be pivoted between a vertical position as illustrated, for example, in FIG. 1 and a horizontal position (FIG. 13) by about 90°, the vertical position being the upright position 89 of the vacuum cleaner. The horizontal position can be used, for example, to move the vacuum cleaner under pieces of furniture sitting low to the ground or to store the vacuum cleaner in narrow storage compartments. For the ergonomic guidance of the vacuum cleaner, the handle rod 2 can be locked in a working position 92 which is preferably about 45°, see FIG. 13. In order to be able to guide the vacuum cleaner for several hours without signs of fatigue, it may be useful to provide other lockable working positions may be provided. In addition, the handle rod 2 can be extended telescopically in its axial direction 91, so that the vacuum cleaner can also be operated without causing fatigue by persons of different heights. A height-adjustable handle rod of this kind can also be provided in the practical example of FIG. 1.

Similarly, to the rear 88 of the bottom portion 16 there are wheels 7 which bear the main weight of the vacuum cleaner. In order to prevent that the vacuum cleaner can tip backwardly, the rotational axis 9 of the wheels 7, when viewed in the travel direction 5, lies preferably behind the axis of rotation 34 of the drive motor 3. The main weight of the vacuum cleaner thus lies in front of the rotational axis 9 of the wheels 7, so that an erecting torque acting at rotational axis 9 keeps the vacuum cleaner in an upright positions. As the handle rod 2 can pivot about the axis of rotation 34 of the drive motor 3, it is thus ensured that both in the standing position and in the working position of the handle rod 2, the weight of the vacuum cleaner is carried in every situation by the wheels 7 and the coasters 66. The cleaner cannot tip over; the operator is thus completely relieved of the weight of the machine.

In the embodiment of FIGS. 12–23 it is provided that, for further filtering the suction air stream exiting the receiving chamber 14, a fine dirt box 94 is arranged in which a fine dirt receptacle 96 is fitted for filtering the fine dirt, see FIGS. 14 and 16 to 18. The suction air stream exiting the receiving chamber 14 may still contain fine particles of dirt and dust which are filtered out in the fine dirt box 94.

Figure 14:
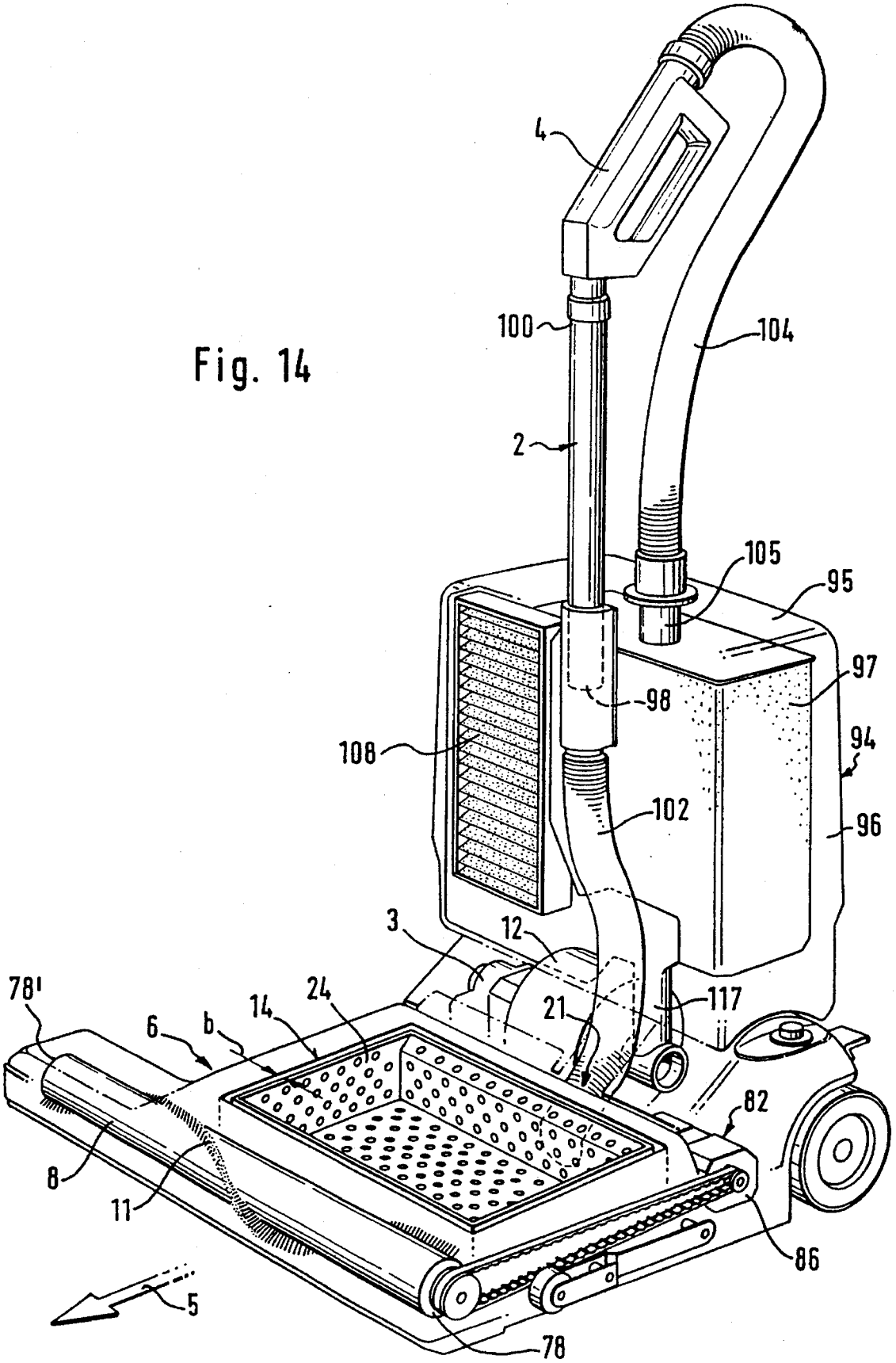
FIG. 14 shows a perspective view of an inventive vacuum cleaner with fine dirt box and an electric motor for driving the brush roller.

The suction air stream leaves the receiving chamber 14 through an exhaust air channel 21 into which a hose 102 opens, which is led through the fine dirt box 94, FIG. 14. The hose 102 opens, at its end facing away from the receiving chamber 14, in the bottom end piece 98 of the handle rod 2, the interior of which is preferably used as an air conveying component. The bottom end piece 98 of the handle rod 2 is joined, advantageously detachable to the hose 102, for example, by a plug connection, in order to separate the handle rod from the hose 102 and to be able to use the resulting free end 98 of the handle rod as a suction nozzle, for example, to be able to suck dirt from corners with difficult access or from upholstery. In addition, residues of dirt and dust which, after removing the dirt collecting container 24 laden with coarse dirt are situated in the receiving chamber 14 are easily extracted and cleaned with the aid of the suction nozzle formed in this way.

The other end 100 of the handle rod 2 remote from the dirt collection box 94 is similarly expediently connected to a flexible hose 104 which is led into the fine dirt container located in the fine dirt box 94. It has proved to be expedient to use the handgrip 4 also as an air-carrying component between handle rod 2 and hose 104.

The hoses 102 and 104 are advantageously constructed as stretch-hoses, which has the advantage, especially with a detached handle rod 2, that the working radius of the handle rod used as a suction nozzle can be increased by stretching of the hose 104, preferably to a radius of over 2.5 m.

Figure 15:
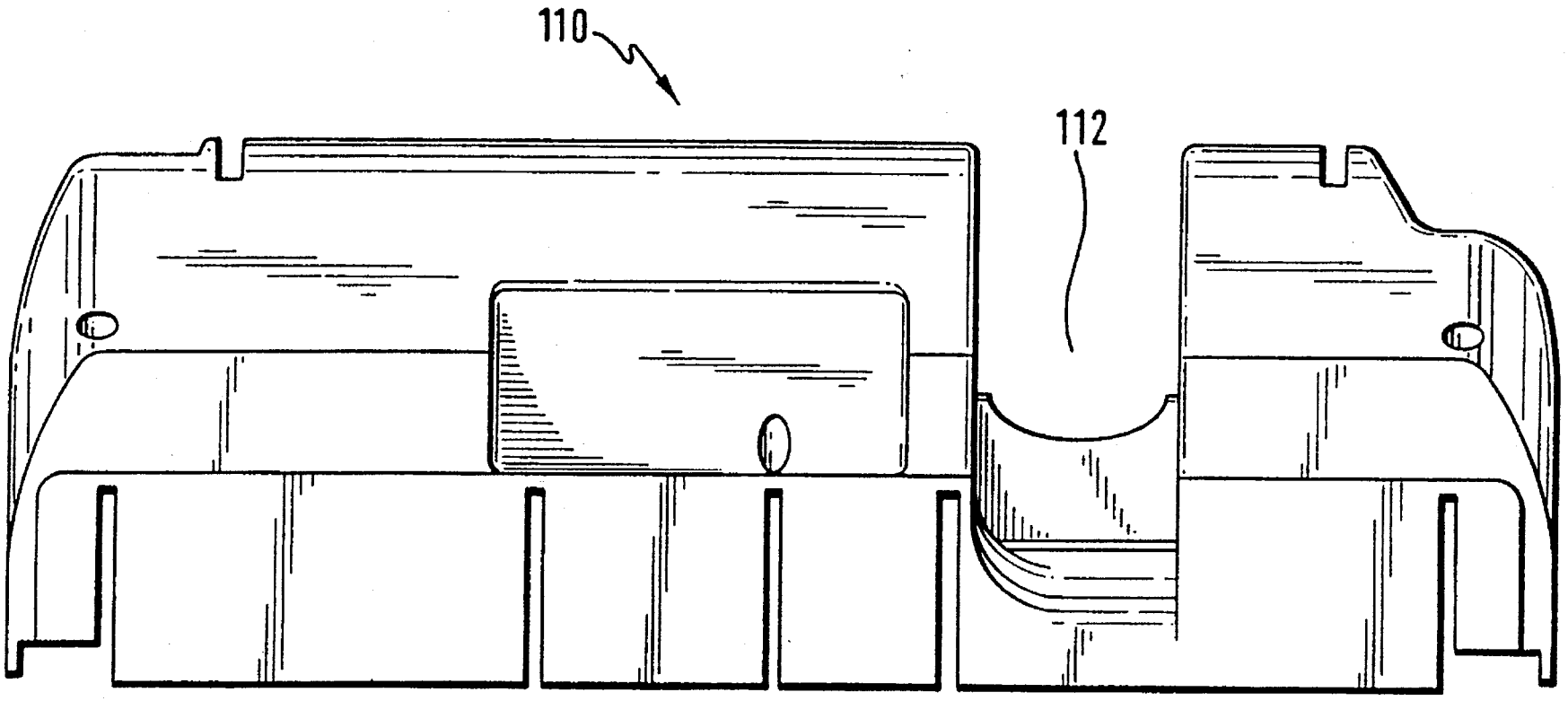
FIG. 15 shows a top view onto a cover cap of the drive motor.
Figure 16:
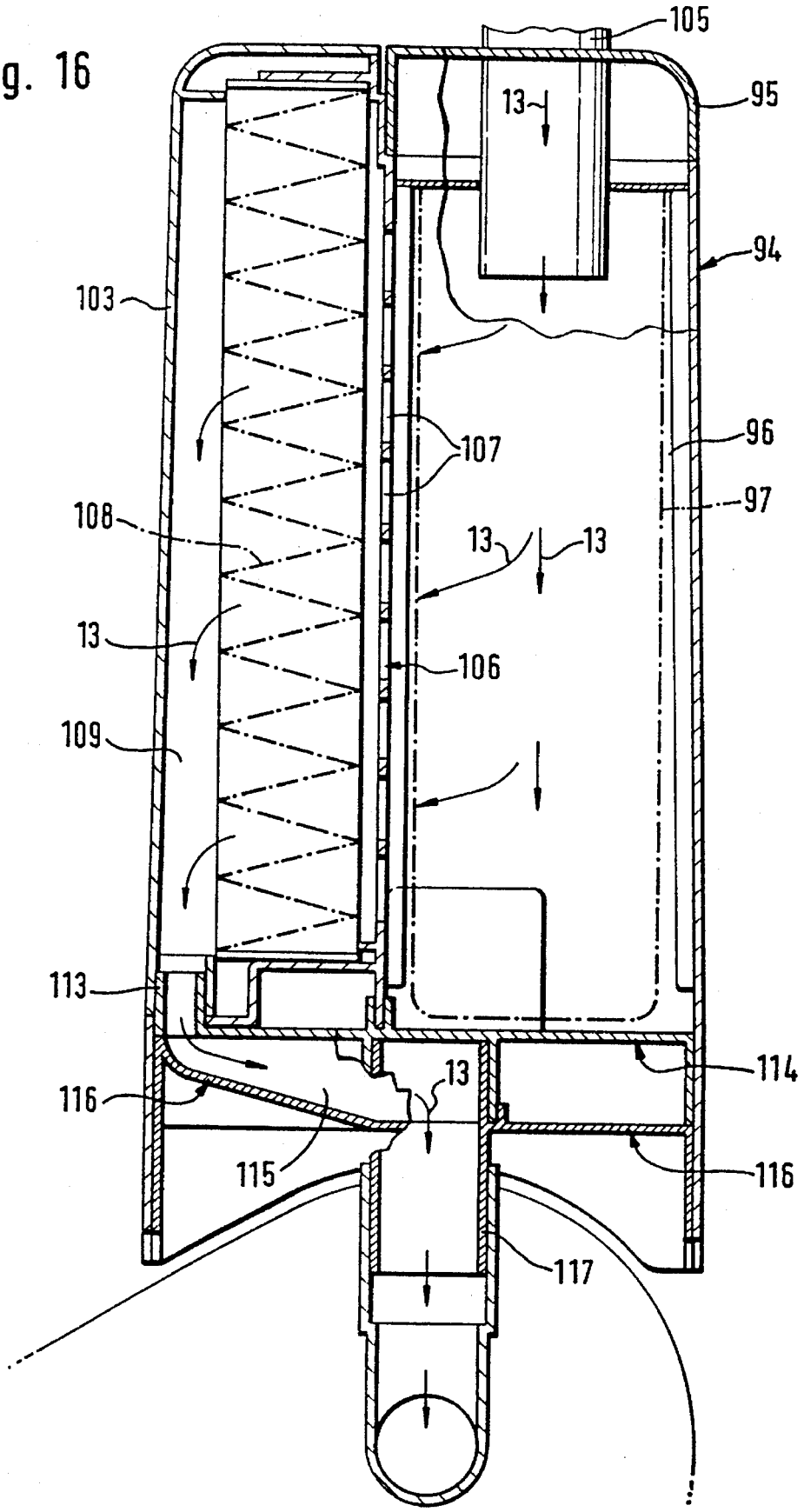
FIG. 16 shows a sectional side view through the fine dirt box.
Figure 17:
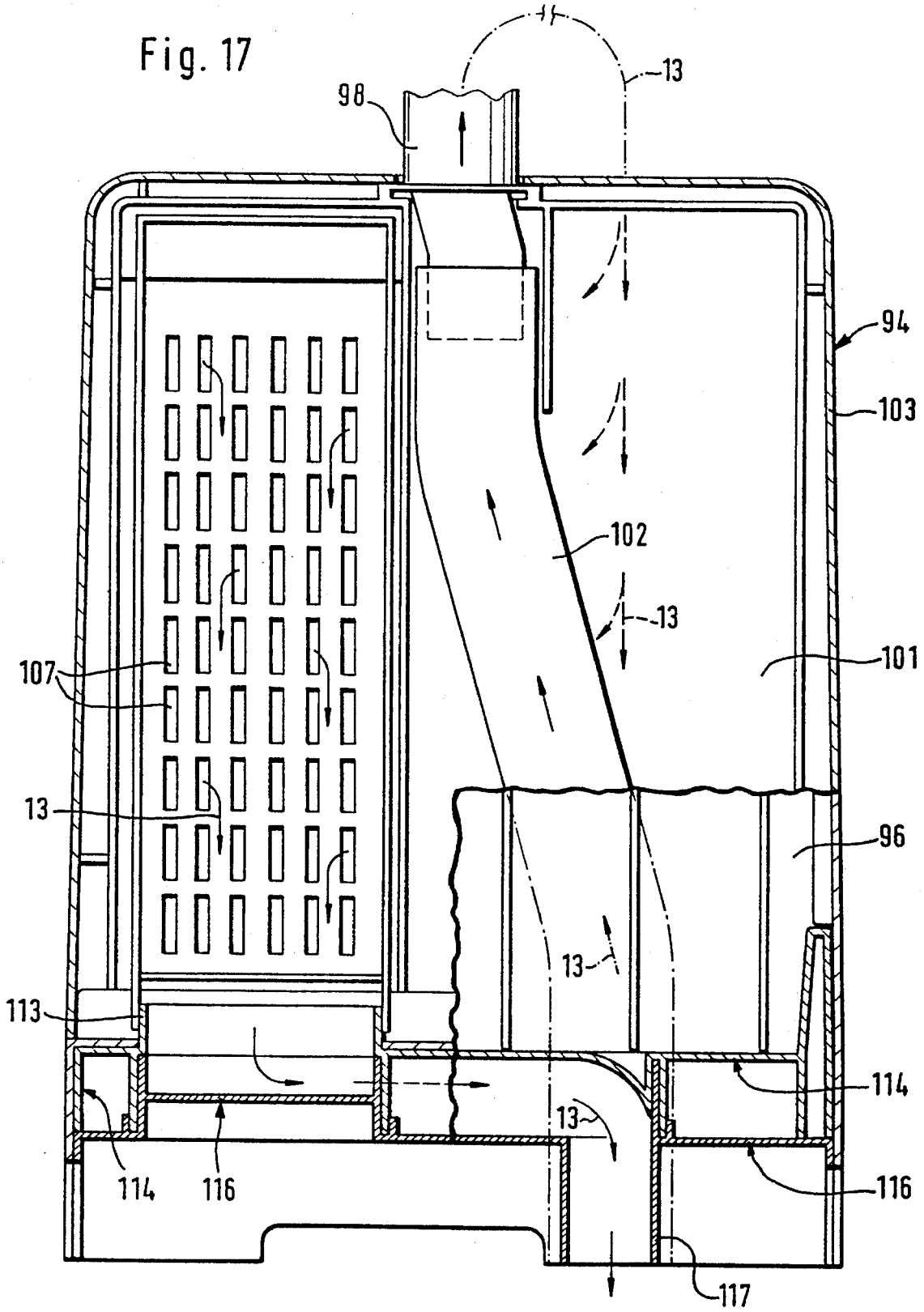
FIG. 17 shows a sectional front view through the fine dirt box.

For a type of construction which saves the greatest possible amount of space, it may be expedient to fit a motor cap 110 according to FIG. 15 with a more or less rectangular recess 112 rounded off at one end approximately in the shape of an arc, which covers the drive unit 82 and the suction blower 12, into which the hose piece 102 coming from the receiving chamber 14 is inserted. When the handle 2 is pivoted from the vertical rest position into the horizontal stretched position and back, the hose 102, especially if it is constructed as a stretch hose, performs a strong stretching movement or contraction, whereby the external hose diameter changes also. The open guidance of the hose 102 through the recess 112 of the motor cap 110 does not obstruct these contraction and stretch movements in any way.

The hose 104 led back into the fine dirt box 96 opens into a pipe 105 which projects through a removable cover 95 of the fine dirt box 94 into the fine dirt receptacle 96. A fine dirt filter 97 is advantageously inserted in the fine dirt receptacle 96. It is possible to introduce this filter 97 when the cover 95 is removed from the top. The filter 97 holds back the fine particles of dirt and dust. The fine dirt filter 97 is expediently a double-layer paper filter bag with a capacity of about 5 liters. As can be taken from FIG. 16, a dust filter 108 can be located downstream of the fine dirt receptacle 96, which holds back the finest dust and bacteria and preferably has a filter surface of about 1 $m^2$. The vacuum cleaner can thus also be used for cleaning clean rooms, for example, production facilities for microchips.

Figure 24:
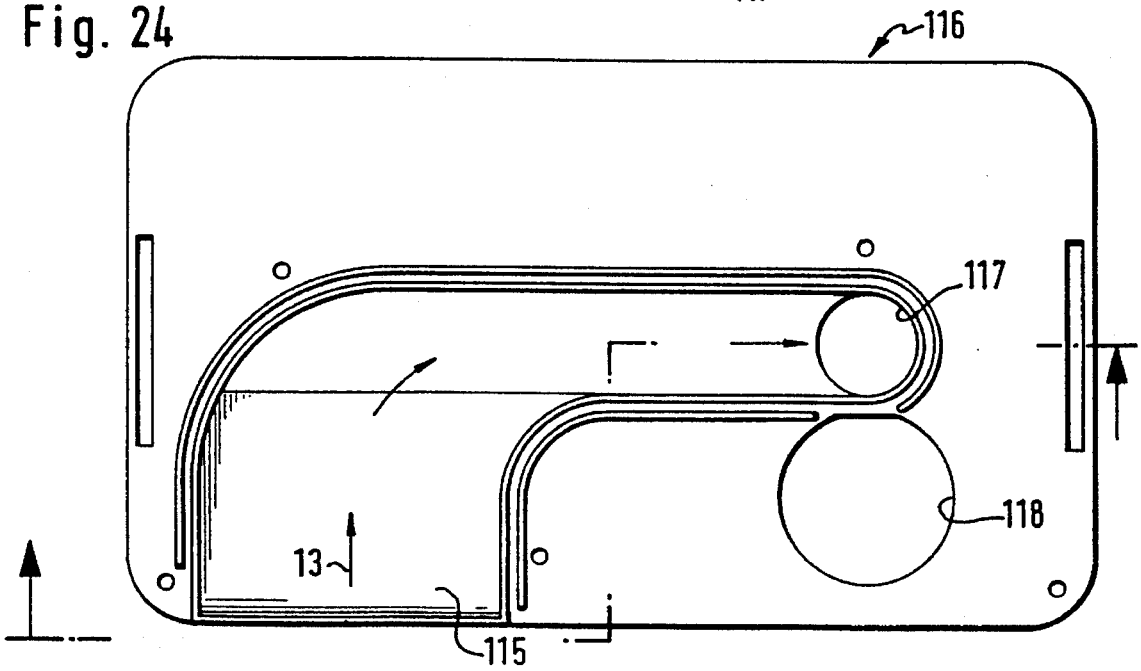
FIG. 24 shows a top view of the baffle plate.

The suction air stream 13 flows through the filter 97 in the fine dirt receptacle 96 and passes through passage apertures 107 which are located on the exhaust air side 106 of the fine dirt receptacle 96, into the dust filter 108. The cover 95 can be divided into two parts in order to be able to take the filter 97 and the dust filter 108 from the fine dirt box 94 independently of each other. After flowing through the dust filter 108 the suction air stream 13 is led into an exhaust channel 109, from which the suction air stream 13 exists downwardly through a pipe 113 projecting into the exhaust channel 109. The pipe 113 is constructed in one piece with a bottom part 114 which delimits the underside of the fine dirt box 94, see FIG. 19 to 21. A deflecting part 116 is flanged onto the underside of the bottom section 114, see FIGS. 22 to 24. The bottom section 114 and the deflecting part 116 jointly form an air guidance 115 into which the pipe 113 coming from the top opens. In cross-section the air guidance system 115, in a top view according to FIGS. 19 or FIG. 24, has a shape that is angled at a right angle and that tapers toward one end. The suction air stream 13 coming from the pipe 113 is led through the air guidance system 115 which runs more or less parallel to the cover 95. The air guidance system 115 is led around a passage bore 118 which, extends when the a bottom section 114 and deflecting section 116 are placed on top of each other, through both components 114, 116 as a continuous bore. The hose 102 coming from the exhaust air channel 21 is led upwards to the bottom end piece 98 of the handle rod 2 through the passage bore 118, see FIG. 17.

The air guidance system 115 opens into a pipe 117 extending downwardly and belonging to the deflecting section 116. Through the pipe 117 the suction air stream 13 leaves the fine dirt box 94. Then, the suction air stream 13 is led to the suction blower 12 and then through outlet openings 42 in the bottom portion 16 into the atmosphere.

Figure 25:
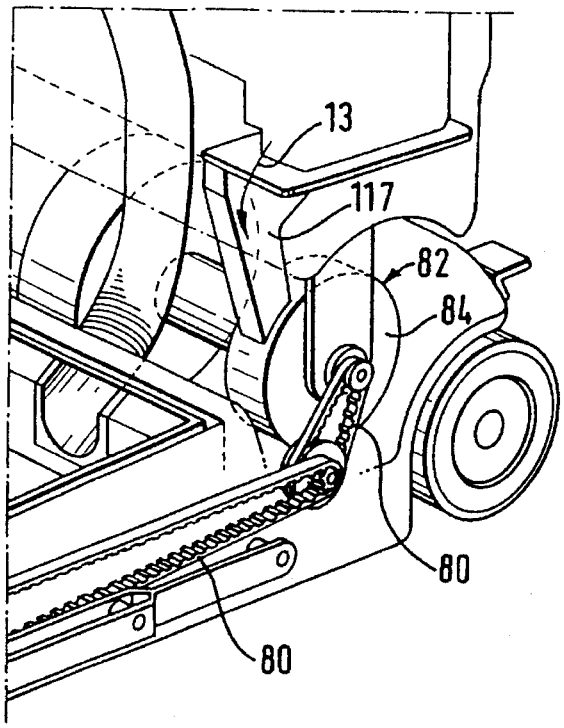
FIG. 25 shows a perspective detail of the vacuum cleaner with a discharge turbine and drive belts.

However, the air stream 13 can also be led first to a turbine 84 which drives the brush roller 8, see FIG. 25. After flowing through the turbine 84, the air stream is again led to the suction blower 12, from where it leaves the vacuum cleaner toward the floor through the outlet openings 42.

Figure 18:
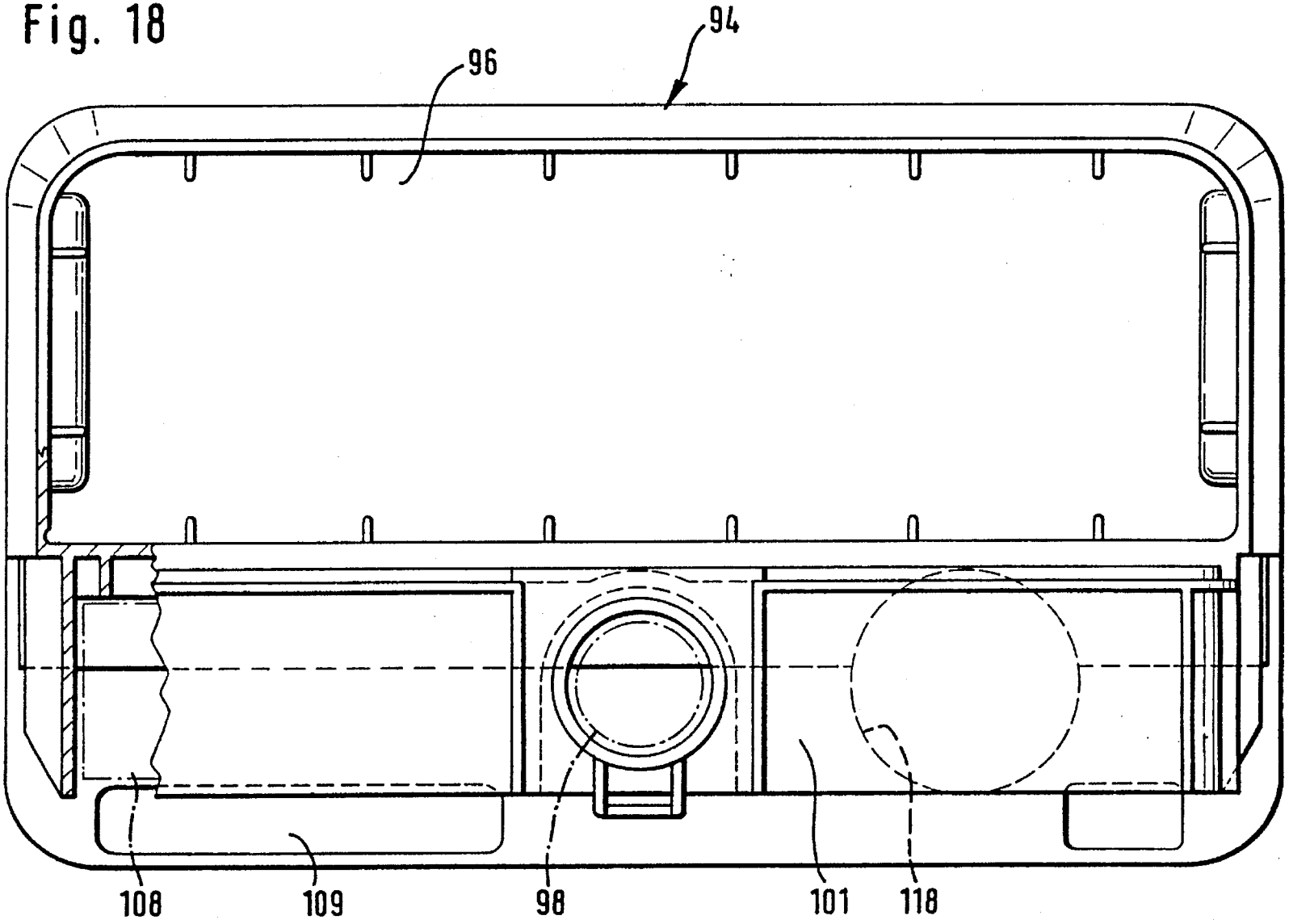
FIG. 18 shows a top view of the fine dirt box.
Figure 19:
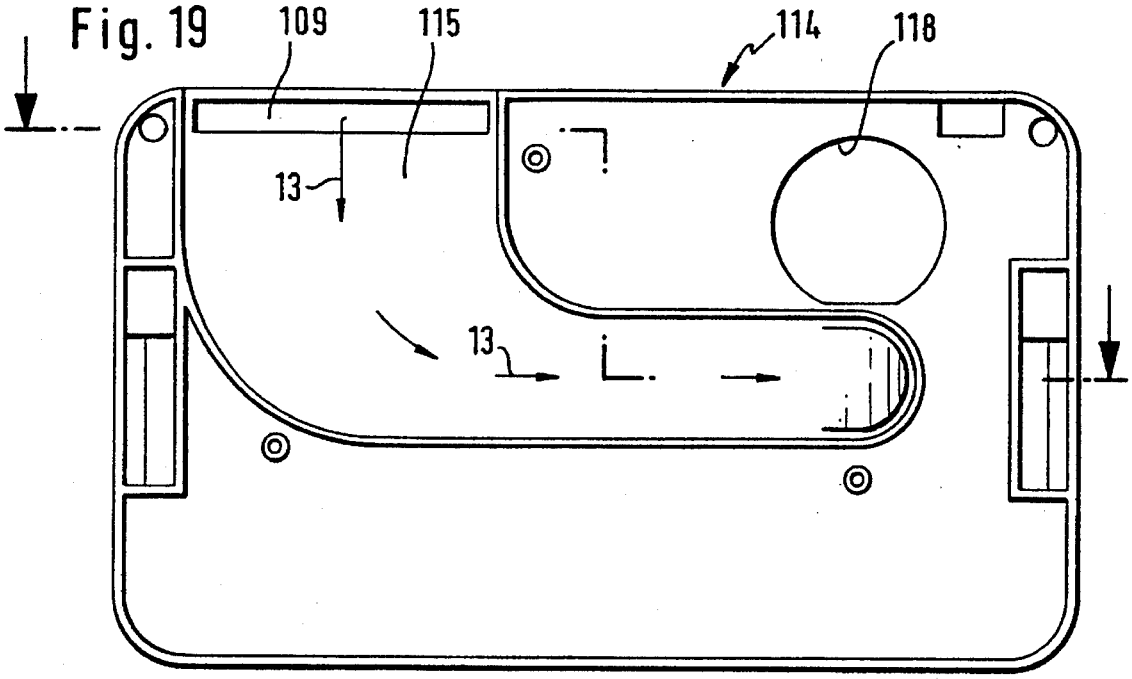
FIG. 19 shows a rear view of a lower section of the fine dirt box.
Figure 20:
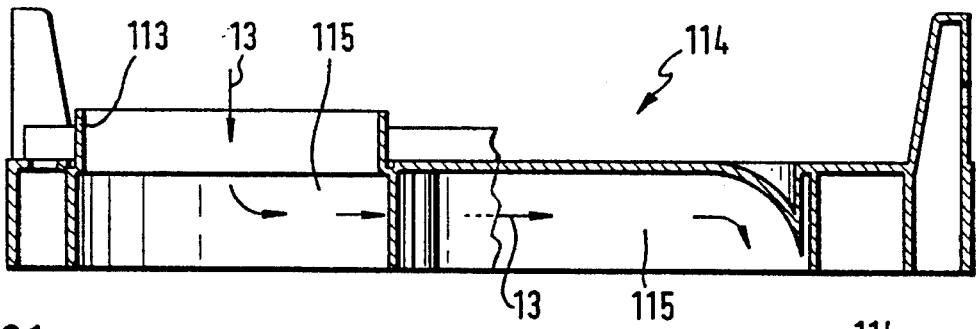
FIG. 20 shows a sectional front view of the lower section.
Figure 21:
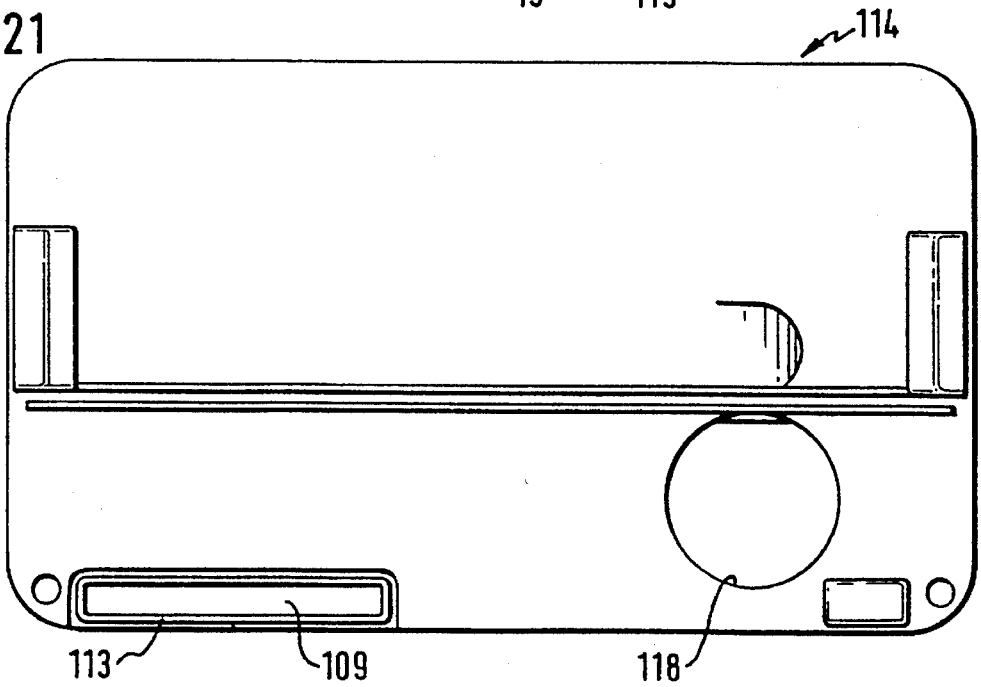
FIG. 21 shows a top view of the lower section.
Figure 22:
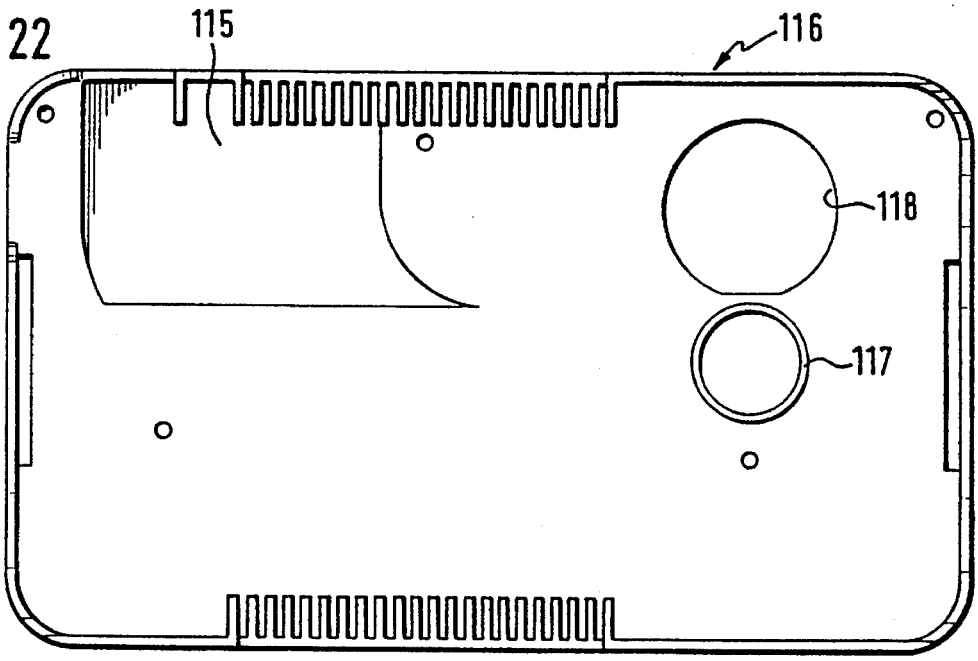
FIG. 22 shows a rear view of a baffle plate engaging the lower section.
Figure 23:
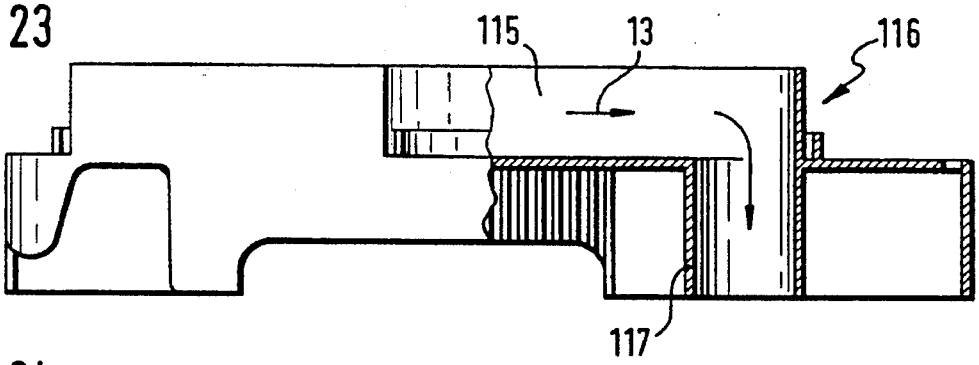
FIG. 23 shows a sectional front view of the baffle plate.

In the front zone of the fine dirt box 94 a receiving chamber 101, see FIGS. 14 and FIG. 18, extends over the entire height of the fine dirt box, which extends parallel to the dust filter 108 and through which the hose 102 is led upwards to the handle rod 2. This receiving chamber 101 provides enough storage space to hold, in addition to the hose 102, also small tools and accessories such as clip-on nozzles and replacement filters. The receiving chamber 101 can be accessed through a removable front section 103 of the fine dirt box 94. At the same time the hose 102 is made accessible for maintenance.

Figure 26:
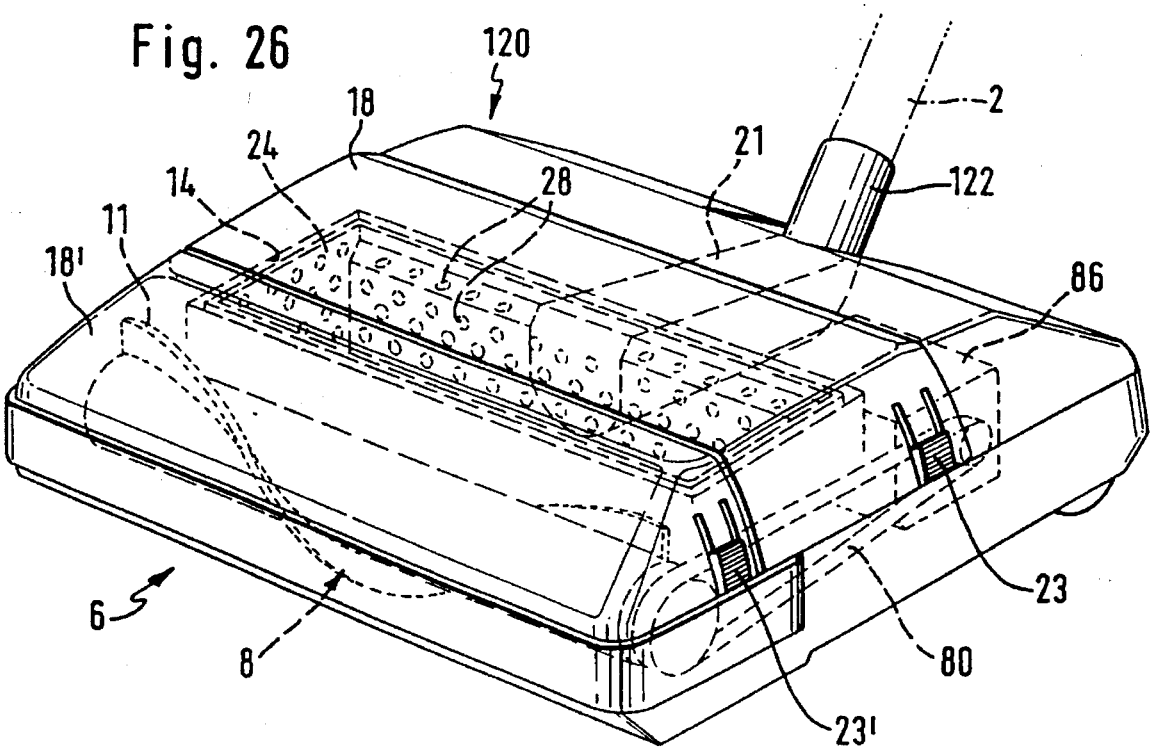
FIG. 26 shows a perspective view of a suction nozzle without drive motor.

Another practical example is illustrated in FIG. 26. The housing 6 is constructed as a suction nozzle 120 which does not have its own drive motor for a suction blower, but can be employed as an accessory part for conventional vacuum cleaners. The suction nozzle consists essentially of the brush roller 8 driven by the brush roller motor 86, the receiving chamber 14, and also the dirt collecting container 24 having perforations 28. The exhaust air channel 21, through which the suction air flows from the receiving chamber 14, opens into a suction pipe 122, into which a handle rod 2 can be inserted. The receiving chamber 14 and the zone above the brush roller 8 are sealed by a two-part cover 18, 18'. It is possible open the part covers independently from each other by opening catches 23, 23'. As the suction nozzle 120 itself contains no drive motor and no suction fan, the suction nozzle is expediently suited as an accessory for conventional floor vacuum cleaners which have their own drive motors.

It is expedient for all the entry and passage apertures through which the suction air flows, such as, for example, the suction slot 10, the perforations 28 in the dirt collecting container 24, the outlet openings 42 etc. to have rounded corners and edges, in order to prevent dirt particles carried along in the suction air stream from clogging the apertures.

The present invention is, of course, in no way restricted to the specific disclosure of the specification and drawings, but also encompasses any modifications within the scope of the appended claims.

What I claim is:

1. A vacuum cleaner comprising:

a housing having a bottom portion with wheels for rolling said vacuum cleaner across a floor;

a handle rod with a handle for guiding and pushing said vacuum cleaner across a floor, said handle rod connected to said housing;

a suction blower with a drive motor positioned in said housing;

said housing comprising a brush roller chamber;

a rotatably driven brush roller with brush elements positioned in said brush roller chamber;

said housing having a suction slot through which said brush elements of said brush roller extend;

said housing further comprising a receiving chamber positioned between said brush roller chamber and said suction blower;

a removable dirt collecting container received in said receiving chamber;

said dirt collecting container having sidewalls, wherein a first one of said sidewalls faces said brush roller chamber, wherein said first sidewall has an inlet slot extending substantially over the length of said brush roller chamber for allowing passage of a suction air stream entering said brush roller chamber through said suction slot into said dirt collecting container;

a suction channel connecting said brush roller chamber to said inlet slot for guiding the suction air stream from said brush roller chamber to said inlet slot, said suction channel tapering in a flow direction of the suction air stream;

said suction channel extending substantially over the length of said brush roller from a periphery of said brush roller upwardly to said inlet slot;

said suction channel comprising a guide wall located adjacent to said bottom portion and extending upwardly at a slant, said guide wall having a lower edge facing said brush roller chamber and delimiting said suction slot.

2. A vacuum cleaner according to claim 1, wherein said suction channel and said dirt collecting chamber form a unitary part.

3. A vacuum cleaner according to claim 1, wherein said suction channel has a free end facing said brush roller chamber, said free end partially enclosing the periphery of said brush roller.

4. A vacuum cleaner according to claim 3, wherein said free end partially encloses the periphery of said brush roller about an angle at circumference of 90° to 180°.

5. A vacuum cleaner according to claim 1, wherein said suction channel has an exterior surface with a wraparound receiving element for receiving a seal for air-tightly sealing off said receiving chamber.

6. A vacuum cleaner according to claim 1, wherein said dirt collecting container is positioned in said receiving chamber such that said sidewalls of said dirt collecting container are spaced from walls of said receiving chamber, wherein at least one of said sidewalls is provided with holes.

7. A vacuum cleaner according to claim 1, wherein said bottom portion comprises a receiving dome, positioned between said brush roller chamber and said receiving chamber, for receiving at least one caster.

8. A vacuum cleaner according to claim 7, wherein said caster is a guide caster that swivels about a vertical axis.

9. A vacuum cleaner according to claim 7, comprising a plurality of said casters, further comprising a shaft for connecting said casters, wherein said shaft is positioned perpendicular to a direction of travel of said vacuum cleaner and is eccentrically supported within said housing, said casters being height-adjustable with said shaft.

10. A vacuum cleaner according to claim 1, wherein said brush roller projects with one axial end laterally past said receiving chamber.

11. A vacuum cleaner according to claim 1, wherein said bottom portion comprises outlet openings facing the floor for exhausting the suction air stream.

12. A vacuum cleaner according to claim 1, wherein said handle rod is connected to a rearward portion of said housing so as to be pivotable from a substantially upright position about 90°, wherein the pivot axis of said handle rod is the axis of rotation of said drive motor.

13. A vacuum cleaner according to claim 12, wherein said handle rod is arrestable in a working position in which said handle rod is pivoted by 45° relative to said upright position.

14. A vacuum cleaner according to claim 12, wherein said axis of rotation of said drive motor, when viewed in a direction of forward travel of said vacuum cleaner, is positioned before a rotational axis of said wheels.

15. A vacuum cleaner according to claim 1, further comprising a fine dirt box with a fine dirt receptacle connected to said handle rod, said fine dirt box arranged downstream of said dirt collecting container in the flow direction of the suction air stream.

16. A vacuum cleaner according to claim 15, wherein the suction air stream is guided through said handle rod.

17. A vacuum cleaner according to claim 16, further comprising a first hose for connecting an end of said handle rod facing said fine dirt box to said receiving chamber and a second hose for connecting an end of said handle rod facing away from said fine dirt box to said fine dirt receptacle.

18. A vacuum cleaner according to claim 15, wherein said fine dirt box further comprises a dust filter arranged downstream of said fine dirt receptacle, wherein said dirt filter has a filter surface area of substantially 1 $m^2$.

* * * * *